US005722937A

United States Patent [19]

Smith

[11] Patent Number: 5,722,937

[45] Date of Patent: Mar. 3, 1998

[54] EXERCISE PHYSICAL REHABILITATION AND TESTING METHOD AND APPARATUS WITH CYCLOIDAL REDUCER

[75] Inventor: James F. Smith, Smithtown, N.Y.

[73] Assignee: Cybex International, Inc.

[21] Appl. No.: 633,503

[22] Filed: Apr. 17, 1996

Related U.S. Application Data

[63] Continuation of Ser. No. 221,896, Mar. 30, 1994, abandoned.

[51] Int. Cl.[6] ..... A63B 21/00

[52] U.S. Cl. ..... 601/23; 601/24; 482/4; 482/137; 482/142; 482/908

[58] Field of Search ..... 601/5, 23, 24, 601/26, 33, 34, 35; 482/4, 6, 51, 136, 137, 142, 900, 901, 902, 908; 73/379.01, 379.06; 74/399; 475/169, 178; 128/774, 782

[56] References Cited

U.S. PATENT DOCUMENTS

| | | | |
|---|---|---|---|
| 2,616,416 | 11/1952 | Gillmeier . | |
| 2,735,422 | 2/1956 | Jones . | |
| 2,784,591 | 3/1957 | Schoor . | |
| 3,134,378 | 5/1964 | Harwood . | |
| 3,285,070 | 11/1966 | McDonough . | |
| 3,301,553 | 1/1967 | Brakeman . | |
| 3,374,675 | 3/1968 | Keropian . | |
| 3,465,592 | 9/1969 | Perrine . | |
| 3,580,244 | 5/1971 | Graves . | |
| 3,713,438 | 1/1973 | Knutsen . | |
| 3,744,480 | 7/1973 | Gause et al. . | |
| 3,784,194 | 1/1974 | Perrine . | |
| 3,789,676 | 2/1974 | Brems . | |
| 3,822,599 | 7/1974 | Brentham . | |
| 3,869,121 | 3/1975 | Flavell . | |
| 4,149,713 | 4/1979 | McLeod | 601/24 |
| 4,177,695 | 12/1979 | Grove | 475/178 |
| 4,276,887 | 7/1981 | Hofstein . | |

(List continued on next page.)

FOREIGN PATENT DOCUMENTS

| | | |
|---|---|---|
| WO 91/11221 | 8/1901 | European Pat. Off. . |
| 251 656 A | 7/1988 | European Pat. Off. . |
| WO 91/11219 | 8/1991 | European Pat. Off. . |
| WO 91/11220 | 8/1991 | European Pat. Off. . |
| WO 93/25281 | 12/1993 | European Pat. Off. . |

OTHER PUBLICATIONS

Biodex Medical Systems, Inc., The Biodex Multi-Joint System $2^{AP}$Single Chair 2AP Single Chair System brochure (date unknown).

Biodex Corporation, System 2 price list, Feb. 1991.

Biodex Corporation, Biodex Reflexions, Mar. 1989.

Chattanooga Group, Inc., Kin-Com 125E Series brochure (date unknown).

Chattanooga Group, inc., Kin-Com AP (1993).

Loredan Biomedical, Inc., History of a Physical Therapy Leader, (date unknown).

Loredan Biomedical, Inc., The New Lido Active MJ (1992).

Shimpo Drives, Circulate Reducers (date unknown).

Compudrive Corporation, Orbidrive, Release 187 (date unknown).

Compudrive Corporation, The "Orbidrive" (date unknown).

Mayr, Christian, Precision Gearboxes for Automation, 1990.

*Primary Examiner*—Jeanne M. Clark

[57] ABSTRACT

The present invention discloses an exercise, rehabilitation and extremity testing method and apparatus having a cycloidal speed reducer. A multiposition chair is rotatably mounted to a stand which is slidingly mounted to a track on a platform. A dynamometer is mounted on a pedestal on the platform such that it is capable of rotating about a horizontal axis and a vertical axis. The vertical height of the dynamometer can also be adjusted. An input apparatus capable of engaging the limb or body segment of a user is mounted to an input shaft of the dynamometer. A motor controls the movement of the input shaft through a cycloidal speed reducer. Consequently, the motor controls the movement of the input arm and the user's limb or body segment. The user exercises his muscles by applying force to the input apparatus according to a number of different protocols.

30 Claims, 15 Drawing Sheets

U.S. PATENT DOCUMENTS 4,326,707 4/1982 Strecker .
4,333,340 6/1982 Elmeskog .
4,337,050 6/1982 Engalitcheff .
4,338,831 7/1982 Rodaway ..... 475/169
4,354,676 10/1982 Ariel .
4,402,502 9/1983 Peters .
4,423,481 12/1983 Reid-Green et al. .
4,432,356 2/1984 Sarrell et al. .
4,479,647 10/1984 Smith .
4,492,222 1/1985 Hajianpour .
4,493,485 1/1985 Jones .
4,511,137 4/1985 Jones .
4,544,154 10/1985 Ariel .
4,549,534 10/1985 Zagorski et al. .
4,555,091 11/1985 May et al. .
4,601,468 7/1986 Bond et al. .
4,609,190 9/1986 Brentham .
4,611,787 9/1986 May et al. .
4,621,620 11/1986 Anderson .
4,628,910 12/1986 Krukowski .
4,650,183 3/1987 McIntyre .
4,691,694 9/1987 Boyd et al. .
4,697,477 10/1987 Barr ..... 475/169
4,702,108 10/1987 Amundsen et al. .
4,711,450 12/1987 McArthur .
4,727,860 3/1988 McIntyre .
4,760,759 8/1988 Blake .
4,765,315 8/1988 Krukowski .
4,772,015 9/1988 Carlson et al. .
4,776,587 10/1988 Carlson et al. .
4,802,462 2/1989 Reiss et al. .
4,805,284 2/1989 Obra .
4,885,939 12/1989 Martin .
4,889,108 12/1989 Bond et al. .
4,892,012 1/1990 Kashihara .
4,905,676 3/1990 Bond et al. .
4,907,797 3/1990 Gezari et al. .
4,934,694 6/1990 McIntosh .
4,976,426 12/1990 Szabo et al. .
5,020,795 6/1991 Airy et al. .
5,035,418 7/1991 Harabayashi .
5,054,774 10/1991 Belsito .
5,072,294 12/1991 Engle .
5,078,152 1/1992 Bond et al. .
5,167,590 12/1992 Kratochvil et al. ..... 475/178
5,186,695 2/1993 Mangseth et al. .
5,209,223 5/1993 McGorry et al. .
5,244,441 9/1993 Dempster et al. .
5,263,914 11/1993 Simonson et al. .
5,403,251 4/1995 Belsito ..... 482/142

EXERCISE PHYSICAL REHABILITATION AND TESTING METHOD AND APPARATUS WITH CYCLOIDAL REDUCER

This application is a continuation of application Ser. No. 08/221,896 filed on Mar. 30, 1994, now abandoned.

FIELD OF THE INVENTION

The current invention relates to the fields of fitness, exercise, physical rehabilitation, sports medicine and extremity testing methods and apparatus.

BACKGROUND OF THE INVENTION

Muscle strength and flexibility can be increased through exercise and physical rehabilitation. It is often advantageous to exercise a muscle in various controlled manners to increase muscle strength, to prevent injury and to accelerate recovery from an injury. Also, physicians, physical therapists and other clinicians often need to have an accurate, repeatable way to test and measure the strength and range of motion capabilities of their patients, for instance, during the course of a treatment program over many months for an injured athlete or a stroke victim.

Various types of exercise, rehabilitation and testing protocols include concentric action, eccentric action, continuous passive motion and isometric contractions. Concentric action occurs where the muscle contracts, exerting force in the direction of the motion. Eccentric action occurs where the muscle extends, exerting force against the direction of the motion. Continuous passive motion occurs where the muscle is driven through the range of motion by an apparatus and the muscle does not actively exert any force. Isometric contractions occur when the muscle contracts but the limb is not permitted to move.

Muscles can be exercised or quantitatively tested in numerous ways, including in an isokinetic manner and an isotonic manner. In an isokinetic exercise, the muscle exerts its maximum force over the full range of motion while the limb or body part moves at a constant velocity. In the isotonic mode, the muscle exerts a constant force over the full range of motion while the speed of the motion varies to maintain the force constant.

When a muscle has been damaged, for example, through surgery, injury or nonuse, working the muscle with different types of exercises in different manners will improve recovery. Since the muscle is damaged, the movement of the muscle (both the range of motion and the force exerted over that range) should be controlled to prevent further damage. The progress of muscle rehabilitation can be monitored by measuring the force exerted by the muscle at each point in the range of motion. Further, the physician, physical therapist or clinician should be able to require that the patient exert some minimum level of force over the range of motion to ensure muscle strengthening. It is convenient to have a single apparatus that can be adapted to exercise various muscles rather than numerous apparatus, which would take up more floor space.

Various apparatus are known in the art in which a limb is engaged to an input arm of a dynamometer, and a motor moves or drives the input arm. In these prior art systems, the input arm is connected to the dynamometer's motor, often by a complicated gearing mechanism. The motor controls the movement of the input arm, which movement the user resists or assists, thereby exercising muscles of the limb. The dynamometers of existing apparatus often use worm gears and other intricate gearing mechanisms that require many parts, are expensive to manufacture and, in some environments, such as a physician's office, are too noisy. These mechanisms often have right angle direction changes that increase the total envelope of the dynamometer (i.e., space taken up by the dynamometer). Since the gearing mechanism is often complicated, there is a greater need for replacement parts and greater down time for repair. These apparatus may require that the gearing mechanism be surrounded by a liquid lubricant or coolant, which can leak. Further, the gearing mechanism may have a high inertia which results in a low efficiency and requires that the user exert a large force to begin movement of the input arm. Further, the gearing mechanism may have a high backlash, resulting in a discontinuity during direction changes of the limb when exercising or testing the antagonist muscle groups.

SUMMARY OF THE INVENTION

One aspect of the present invention relates to an apparatus for exercising, physical rehabilitation, or extremity testing. A dynamometer input shaft capable of engaging the limb or body segment to be exercised is attached to a low speed shaft of a cycloidal speed reducer. A high speed shaft is operably engaged to the low speed shaft by the cycloidal speed reducer such that it rotates at a faster speed than the low speed shaft. A motor is operably engaged to the high speed shaft and controls the rotation of the high speed shaft. Operation of the motor thus also controls the motion of the low speed shaft and the limb or body segment, creating either concentric motion or eccentric motion or other modes as may be desired.

In accord with another aspect of the present invention, a method is provided for exercising a limb or body segment. The limb or body segment is engaged to an input apparatus such that the rotation point of the limb or body segment is aligned with an input shaft of a dynamometer. A motor of the dynamometer drives a high speed shaft of a cycloidal speed reducer such that a low speed shaft of the cycloidal speed reducer rotates at a slower speed than the high speed shaft but at a rate proportional to the high speed shaft. The low speed shaft drives the dynamometer input shaft thereby controlling the movement of the limb or body segment.

DETAILED DESCRIPTION OF THE DRAWINGS

Figure 1:
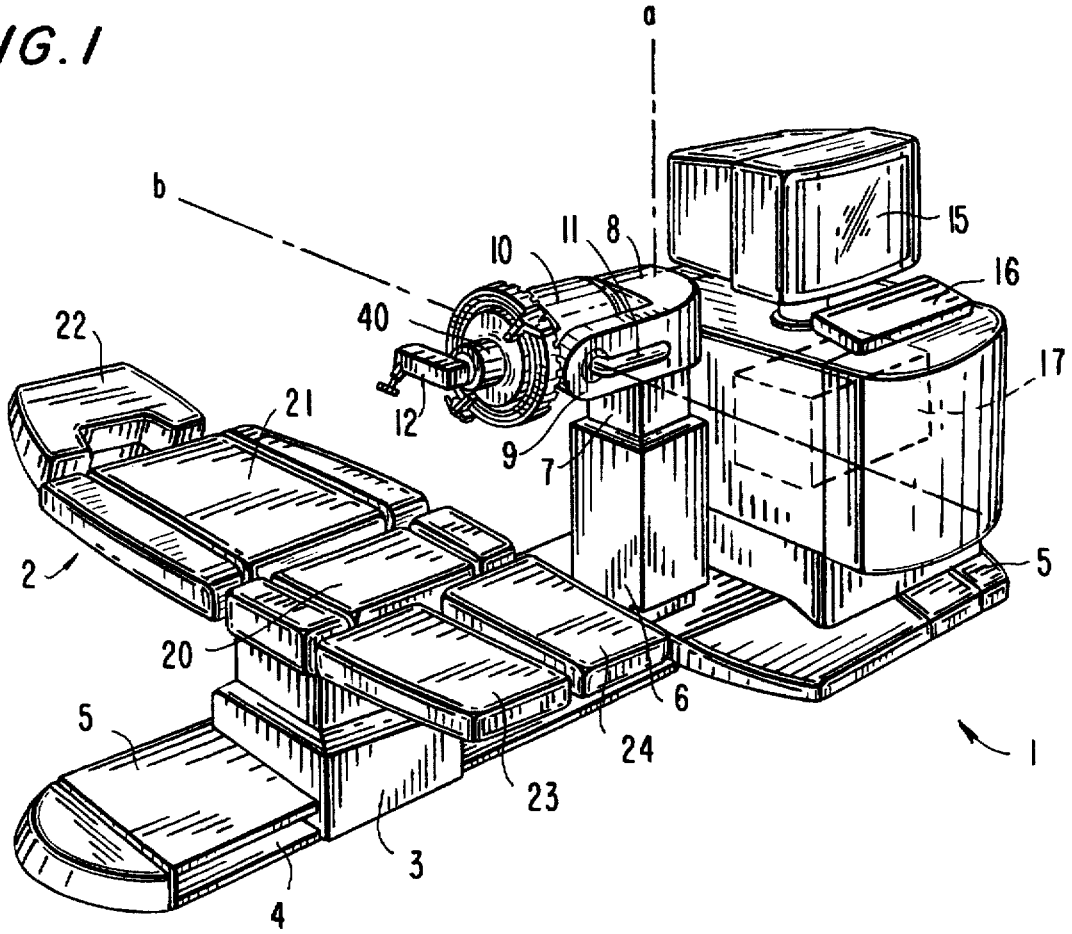
FIG. 1 is a perspective view of an exercise and physical rehabilitation system of the present invention.

FIG. 1 is a perspective view of an exercise, physical rehabilitation and extremity testing system 1 of the present invention. A chair 2 is rotatably mounted on a pedestal 3 and can be locked at a selected orientation by a physical therapist, physician or other service provider. Conveniently, the system can be set up by the patient as well. The pedestal 3 is mounted to a track 4 on a platform 5 such that the pedestal can slide along the length of the track. The pedestal 3 can be locked in a selected position on the track 4. The chair 2 includes a seat 20, a back support 21, a head rest 22, a right leg support 23 and a left leg support 24. A user sits or lies on the chair 2 such that the axis of rotation of the limb or body segment to be exercised, rehabilitated or tested is aligned with an input shaft 40 (FIGS. 2 and 6) of a-dynamometer 10. The positions of the head rest 22, back support 21, left leg support 23 and right leg support 24 can be adjusted to change the position of the user and thus better align the limb to be exercised.

Figure 2:
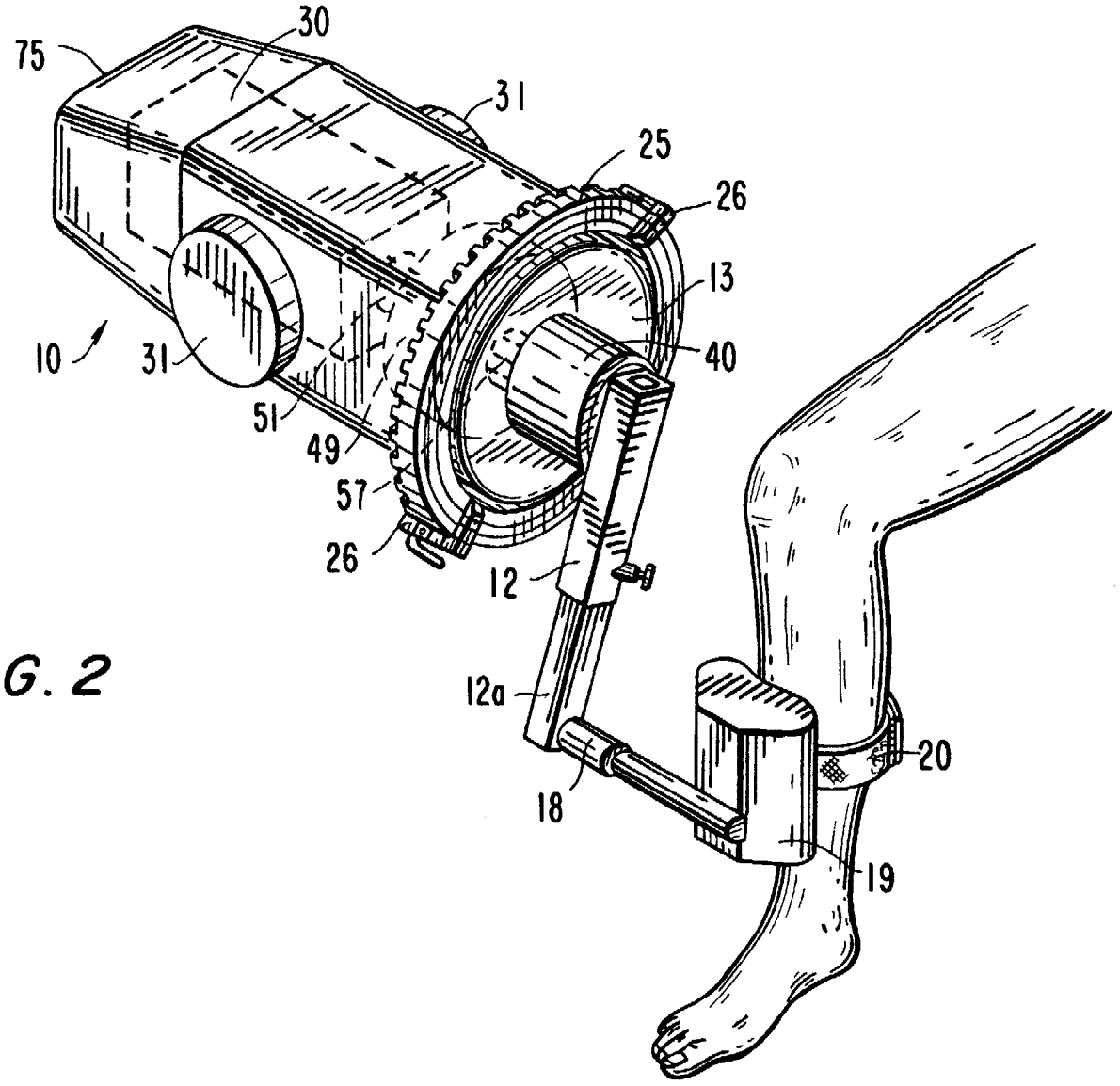
FIG. 2 is a perspective view, shown in isolation, of a dynamometer of the system of FIG. 1 engaged to the leg of a user through an input arm.
Figure 6:
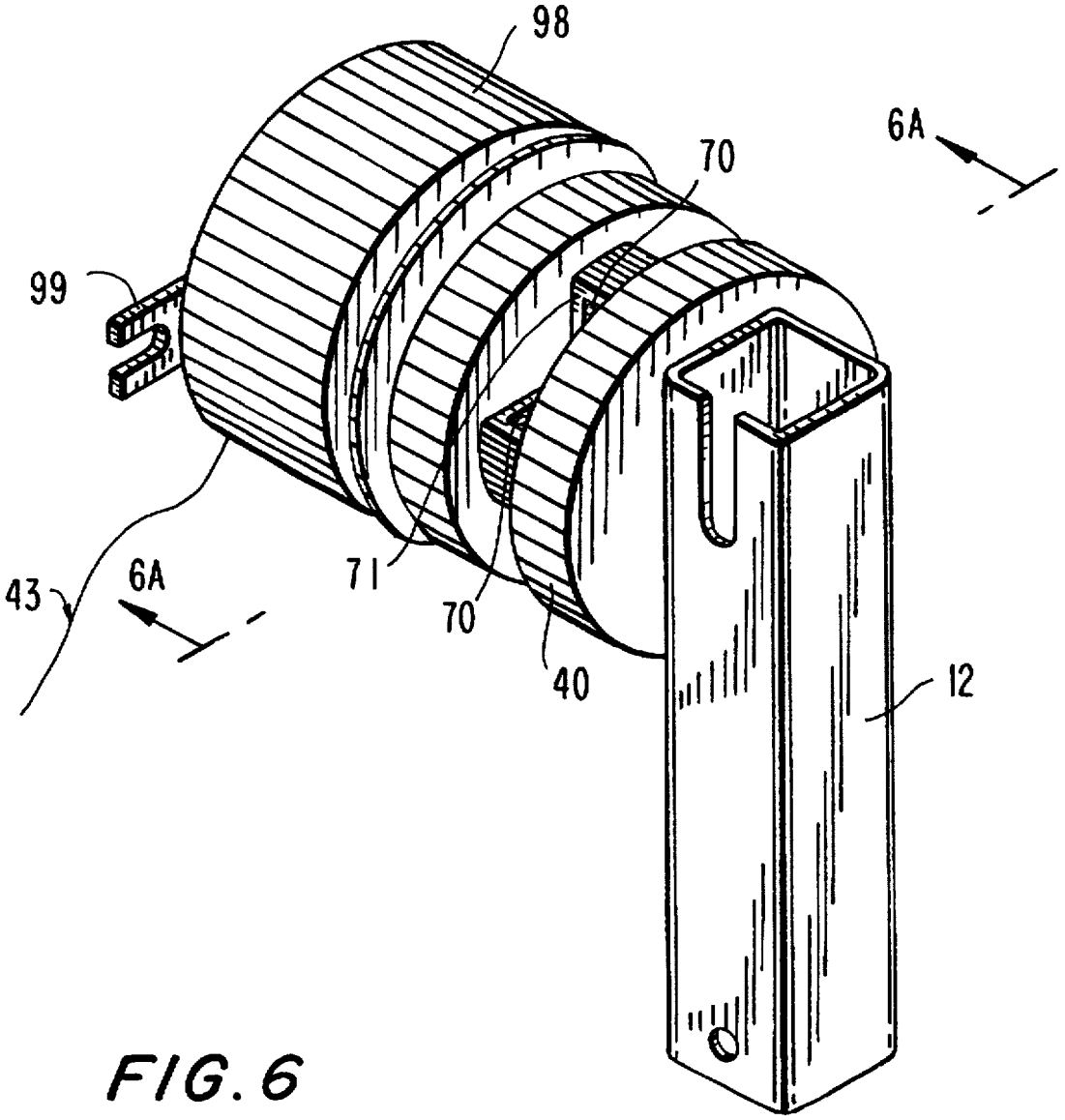
FIG. 6 is a perspective view of the input shaft of the dynamometer of FIG. 2 attached to the input arm.

A stand 6 is fixedly mounted to the platform 5 near one end of the track 4. A post 7 is mounted to the stand 6 such that the post is capable of vertical movement within the stand. The post 7 can be locked in position with respect to the stand 6. A brace 8 is mounted to the post 7 such that the brace 8 can be rotated about a vertical axis a (shown in FIG. 1) and locked at a selected orientation. The dynamometer. 10 is mounted to the brace 8 between two brace arms 9 (only one shown) such that the dynamometer is capable of rotation about a horizontal axis b (also shown in FIG. 1). The brace arm which is not shown is located on the other side of the dynamometer 10. A locking lever 11 is mounted to one brace arm 9 and can be rotated to lock the dynamometer 10 at a fixed orientation. An input arm 12 is mounted to the dynamometer input shaft 40 (FIGS. 2 and 6).

A computer 17 has a display 15 and a keyboard input device 16. The display 15, keyboard 16 and computer 17 are shown mounted on the platform 5. The keyboard 16 and the display 15 can be positioned such that the user, as well as a service provider, can enter the exercise or testing parameters. The computer 17 can also be freestanding such as by mounting on a rolling cart.

The general operation of the system of FIG. 1 is as follows. The user is positioned on the chair 2 in order to engage a limb to the input arm 12 such that the joint of the limb is aligned with the dynamometer 10. The service provider (or user) enters an exercise protocol into the computer 17, using the keyboard 16 and display 15. The computer 17, together with a dynamometer control board 42 (FIG. 3), control the dynamometer 10. The dynamometer 10 drives the dynamometer input shaft 40 and thus controls the motion of the input arm 12 and the limb of the user in response to the instructions provided by the service provider through the keyboard 16, as processed by computer 17 and dynamometer control board 42.

Descriptions of the various parts of the system shown in FIG. 1 are set forth below.

FIG. 2 is a perspective view in isolation of the dynamometer 10 of the system of FIG. 1 engaged to a leg of the user. Preferably, the input arm 12 is composed of two telescoping rods with a detent to lock the input arm at a fixed length. The length of the input arm 12 is selected such that the axis of limb rotation (i.e., the pivot of the joint) is aligned with the axis of rotation of the dynamometer input shaft 40. An engagement device, such as an adapter arm 18, which can also be telescoping, is attached to the free end 12*a* of the input arm 12. In FIG. 2, a pad 19 is mounted to the adapter arm 18 and is adapted to engage the leg of the user. A strap 20 is used to maintain the leg against the pad 19. The length of the input arm 12 is selected such that the axis of rotation of the dynamometer shaft 40 is aligned with the knee, and the pad 19 is positioned on the shin. Other assemblies are well-known in the art for engaging other limbs of the user, such that the pivot of the joint is aligned with the axis of the rotation of the dynamometer input shaft 40. Other engagement devices for performing closed chain exercises, work simulation and back exercises are also well-known in the art and can be used in practicing the present invention. These assemblies and engagement devices are readily available from Cybex Division of Lumex, Inc. for use with the CYBEX® 6000 Extremity System or can be obtained from other such equipment manufacturers.

The input arm 12 is mounted to the input shaft 40 perpendicularly to the axis of rotation of the input shaft. A faceplate 13 is mounted to a housing 75 of the dynamometer 10 about the input shaft 40 such that it is in a plane parallel to the plane of motion of the input arm 12. A mechanical range limiting ring 25 is mounted on the housing 75 about the faceplate 13. A mechanical range limiting stop 26 can be positioned along the range limiting ring 25 to restrict the rotation of the input arm 12 and thus the movement of the limb. Preferably, two mechanical stops 26 can be placed on the ring 25 to limit the permissible range of motion of the input arm 12 in both directions of rotation. Alternatively, the mechanical stops 26 can be removed completely, particularly if it is desired for the input arm 12 to move greater than 360°. Generally, as described below, the range of motion will be limited by the computer control of a motor 30 that drives the input arm 12. The mechanical stops 26 provide an additional measure of safety for a range of movement less than approximately 320°.

Referring again to FIG. 2, the input shaft 40 is operably engaged to a cycloidal speed reducer 49 via a low speed shaft 57. The reducer 49 is operably engaged to the motor 30 via a high speed shaft 51. Mounting hubs 31 are disposed on the sides of the dynamometer 10. The hubs 31 attach to the brace arms 9 (one of which is shown in FIG. 1) to permit the pivotal mounting of the dynamometer 10 to the brace 8.

Figure 3:
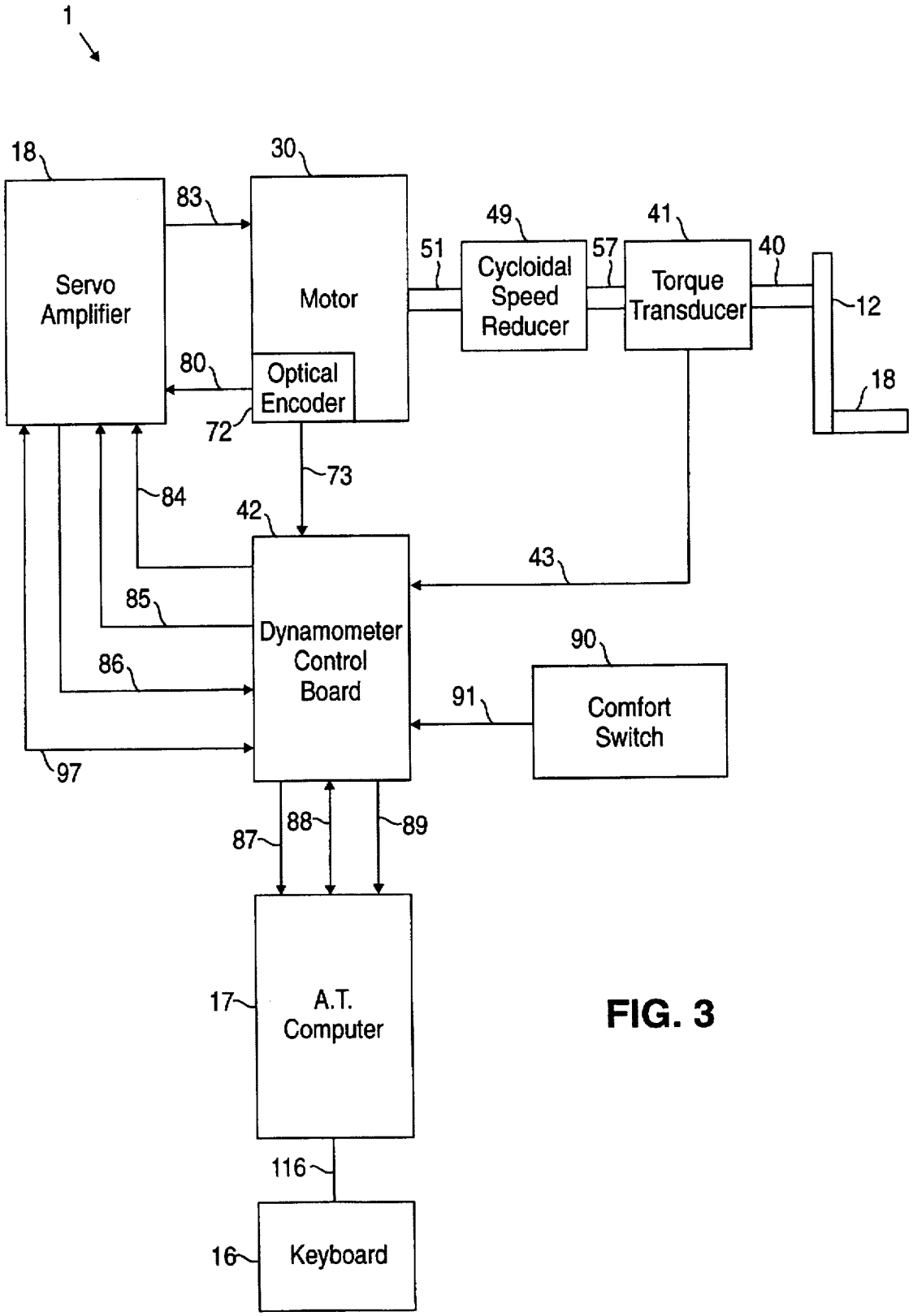
FIG. 3 is a schematic diagram of the system of FIG. 1.

FIG. 3 is a block diagram in schematic form of the input shaft 40 and control system of the system 1 of FIG. 1. Control of the system is performed by the dynamometer control board 42, the computer 17, and a servo amplifier 18. The dynamometer control board 42 is a computer processor and associated hardware that is programmed in accord with the various methods of operation described below. Acceptable computer processors are commercially available from Motorola as model no. 68000 and from Texas Instruments as model no. TMS 32010. The computer 17 is any conventional IBM-compatible computer. One acceptable servo amplifier 18 is commercially available from Reliance Electric, Electrocraft Division, as model no. DM 75 (model no. DM 30 would also be acceptable). Typically, the computer 17 is programmable and can run other software. The dynamometer control board 42, however, is not intended to be reprogrammed by the service provider.

The input shaft 40 is connected to the low speed shaft 57, such as by a direct or close coupled connector. Alternatively, the low speed shaft 57 and the input shaft 40 can be formed by a single shaft. The low speed shaft 57 is operably connected to the high speed shaft 51 through the cycloidal speed reducer 49 such that the low speed shaft rotates at a speed lower than, proportional to, and in the opposite direction of the high speed shaft. Typically, the high speed shaft 51 rotates 35 times faster than the low speed shaft 57. However, a speed ratio of 42 to 1 may also be acceptable. The motor 30 drives the high speed shaft 51. Consequently, the motor 30 controls the speed and position of the low speed shaft 57.

Referring again to FIG. 3, a torque transducer 41 is mounted to the low speed shaft 57 and generates a signal corresponding to the torque on the low speed shaft (and thus the input shaft 40) during exercise of the limb. Preferably, the torque transducer 41 includes a strain gauge 70 (shown in FIG. 6). The torque signal from the transducer 41 is sent to the dynamometer control board 42 along torque input line 43.

The dynamometer control board 42 sends a control signal over a speed control line 84 to the servo amplifier 18. That control signal is based in part on commands input to the system by the service provider by means of the keyboard 16. The servo amplifier 18 amplifies the control signal, sending power to drive the motor 30 over a motor power line 83. The servo amplifier 18 calculates the position and velocity of the motor shaft and sends a modified control signal to the motor to correct for any deviance from the desired response. A signal disabling the system by shutting down the motor 30, such as when the patient feels discomfort (described below) or when there is a power shut down, can be sent along a disable line 85 from the dynamometer control board 42 to the servo amplifier 18. Information regarding the status of the system, such as the current motor power and the position of the high speed shaft 51, is sent from the servo amplifier 18 to the dynamometer control board 42 along status line 86. Other signals, such as clock timing signals, are sent back and forth between the servo amplifier 18 and the dynamometer control board 42 over a communications line 97.

An optical encoder 72 is mounted on the motor 30 so that it can detect the position and velocity of the high speed shaft 51. The encoder 72 sends electrical signals corresponding to the measured position and velocity of the high speed shaft 51 along an encoder input line 73 to the dynamometer control board 42. The signals for the position and velocity are also sent to servo amplifier 18 along motor position line 80. Using this information, the servo amplifier 18 alters the current to the motor 30, increasing or decreasing the motor speed match the speed dictated by the dynamometer control board 42.

Referring again to FIG. 3, during operation, the user holds a comfort switch 90. Should the user feel any pain or discomfort during exercise, he can simply release the comfort switch 90. A safety signal will be sent along safety signal line 91 to the dynamometer control board 42, which will cut off power to the motor 30.

Signals relating to various system errors, such as from the user discomfort switch or when there is a power shut down, are sent from the dynamometer control board 42 to the computer 17 along error line 87. Signals relating to the control and status of the system are sent back and forth between the dynamometer control board 42 and the computer 17 along computer status line 88. Information relating to the torque on the dynamometer input shaft 40 and the position of the high speed shaft 51 are sent from the dynamometer control board 42 to the computer 17 along torque/position line 89. This information can be displayed in numerous formats on the computer display 15, printed out on a printer, or otherwise recorded, for example, on a computer disk or other memory device. In this way, the user's performance can be monitored and recorded. Particularly, the torque generated by the user when exerting force on the input arm 12 can be monitored at each point of the range of motion thus forming one of the basic and fundamental objective measurements used by the service provider to assess the patient.

Other reducers utilizing a similar principle, such as the reducers sold by Compudrive Corporation, Shimpo Drives and Dojen division of Lenze may also be utilized in the present invention.

Figure 4:
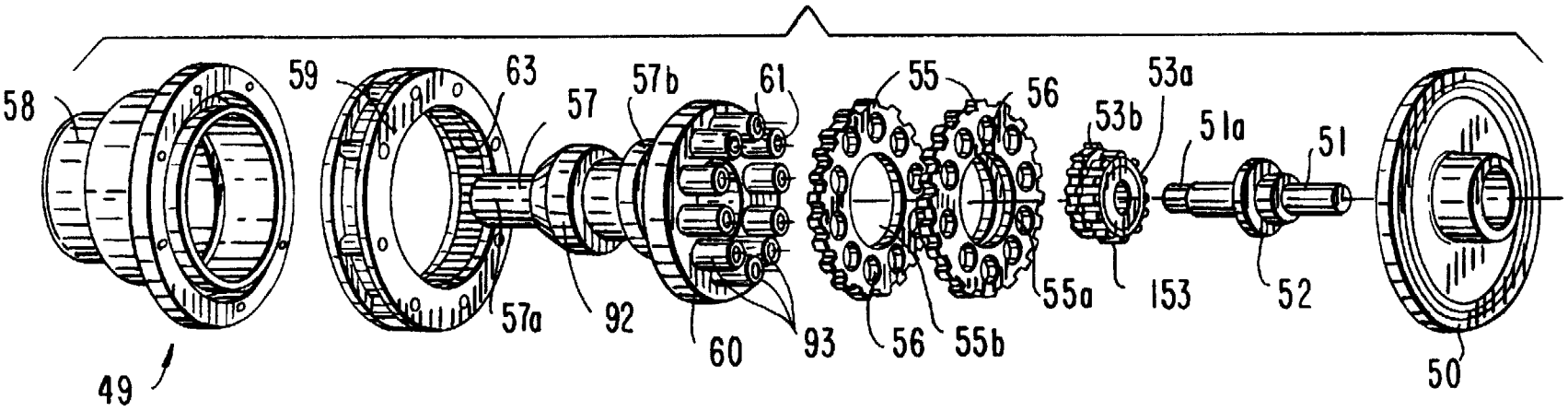
FIG. 4 is an exploded view of a cycloidal speed reducer of the dynamometer shown in FIG. 2.

FIG. 4 is an exploded view of the cycloidal speed reducer 49 acceptable cycloidal speed reducer is commercially available from Sumitommo as model no. VS3100.

A shoulder 52 is disposed on the high speed shaft 51. The shoulder 52 is rotatably mounted in a shield 50 when the reducer 49 is assembled such that the high speed shaft 51 extends through the shield. The end of the high speed shaft 51 that extends out of the shield 50 is operably engaged to the output shaft of the motor 30.

An eccentric cam assembly 53 is mounted to one end 51*a* of the high speed shaft 51. The eccentric cam assembly 53 is composed of two eccentric cams 53*a* and 53*b*. Each cam is positioned 180° out of phase with the other cam about the axis of the high speed shaft 51. Cam rollers 153 are disposed at the periphery of each cam 53*a*, 53*b*. Preferably, there are two cycloidal discs 55, each having a cam hole 55*a*, 55*b* disposed at their centers. Each eccentric cam 53*a*, 53*b* is disposed within a cam hole 55*a*, 55*b*, respectively, of each cycloidal disc 55. The cam rollers 153 permit the cams to rotate easily within the cam holes 55*a*, 55*b*. Because the cams 53*a*, 53*b* are 180° out of phase, the cycloidal discs 55 are similarly out of phase. Therefore, there is no weight imbalance about the rotating high speed shaft 51 because each cam/disc combination is 180° out of phase with the other cam/disc combination. A single cycloidal disc 55 and eccentric cam 53 could also be used with a counterweight to balance the weight about the high speed shaft 51. When two cycloidal discs 55 are used, however, the area of engagement between the discs 55 and ring 59 is doubled, increasing the shock load capacity of the reducer 49 and reducing backlash. Consequently, use of two discs 55 is preferred.

Referring again to FIG. 4, the low speed shaft 57 is rotatably mounted in a casing 58 such that a first end 57*a* extends out of the casing. Preferably, a shoulder 92 is positioned on bearings along the low speed shaft 57 to permit simple mounting to the casing 58. The first end 57*a* of the low speed shaft 57 is operably engaged to the dynamometer input shaft 40, such as by a direct or close coupled connector. A torque transducer 40 having strain gauges 70 is mounted on the low speed shaft 57 (as shown in FIG. 6) on the end 57*a* extending outside the casing 58.

A pin platform 60 is mounted at the second end 57*b* of the low speed shaft 57. Pins 61 are mounted to the pin platform 60. The pins 61 are inserted into pinholes 56 disposed along the periphery of the cycloidal discs 55. Cylindrical bushings 93 are disposed about the pins 61 within the pinholes 56. The bushings 93 ease the motion of the pins 61 within the pinholes 56. A ring 59 is fixedly mounted to the casing 58 about the low speed shaft 57. The cycloidal discs 55 are seated within the ring 59.

FIGS. 5A–D are cut-away views through one cycloidal disc 55 of the assembled cycloidal speed reducer 49. For purposes of clarity, only one cycloidal disc 55 is shown and the bushings 93 (shown in FIG. 4) are left out. The cam rollers 153 of the cam 53 fit snugly within the cam hole 55*a*. Tabs 62 are disposed about the circumference of the cycloidal disc 55. Ring rollers 63 are mounted to an internal circumference of the ring 59. The cycloidal disc 55 is sized so that it can roll around within the ring 59 while the ring rollers 63 engage the tabs 62. Preferably, there is one less tab 62 on the cycloidal disc 55 than there are rollers 63 on the ring 59 which, as explained below, results in the displacement of the disc 55 within the ring 59 by one roller 63 for every rotation of the high speed shaft 51. Because the cycloidal disc 55 rolls around the ring 59, rather than meshing teeth as in a gear, there is less friction and strain on the parts of the speed reducer.

Figure 5B:
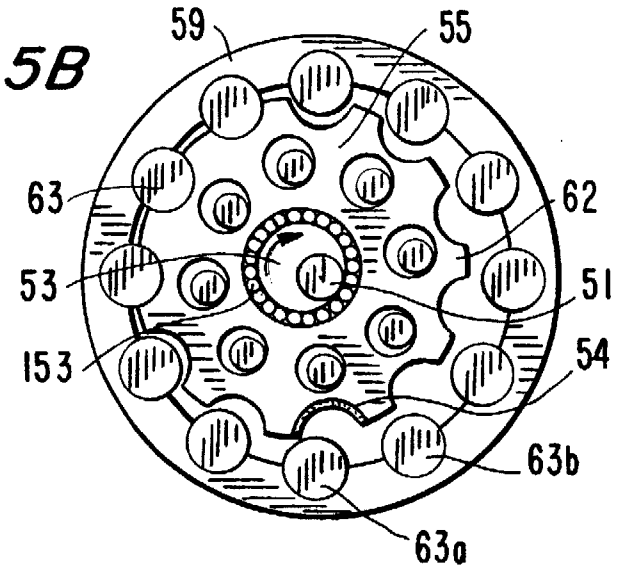
FIGS. 5A–D are cut-away views of the cycloidal speed reducer of FIG. 4 through a cycloidal disc.
Figure 5D:
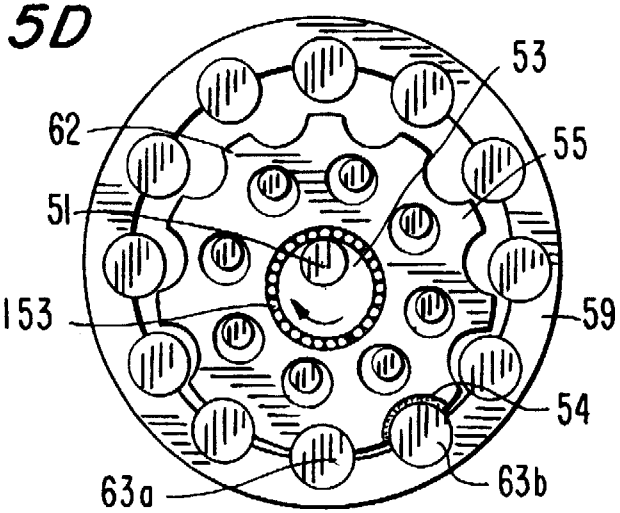
Figure 5A:
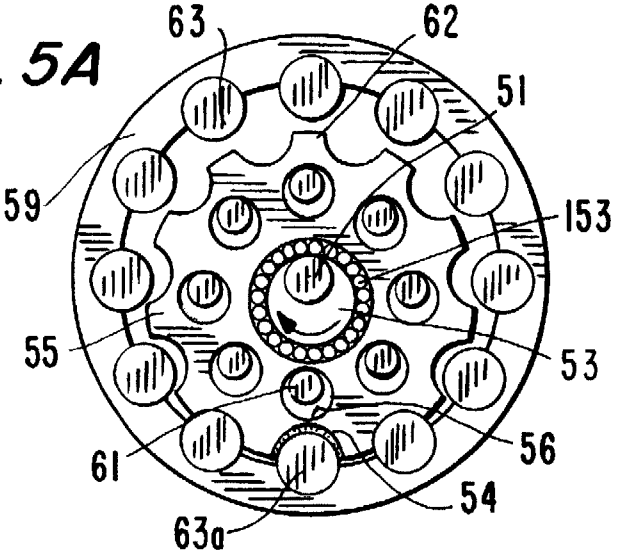

FIG. 5A shows the eccentric cam 53 and the cycloidal disc 55 positioned at the bottom of the ring 59 (i.e., the 6 o'clock position). Notches are positioned between adjacent tabs 62. The movement of one such notch, designated 54 and outlined in FIGS. 5A–D, resulting from rotation of the high speed shaft 51 will be described. The notch 54 is disposed about a bottom ring roller 63*a*. A pin 61 is disposed in a pinhole 56 directly above the bottom ring roller 63*a*.

FIG. 5B shows the high speed shaft 51 rotated 120° in the clockwise direction with respect to FIG. 5A. The cam 53 and the cycloidal disc 55 have rotated 120° and are now at a 10 o'clock position with respect to the high speed shaft 51. Since the pinholes 56 are larger than the pins 61 (or the bushings 93 of FIG. 4), the eccentric movement of the disc 55 is not transferred to the pins. Rather, the pins 61 are displaced only slightly in the counterclockwise direction as a result of the rolling of the disc 55.

Figure 5C:
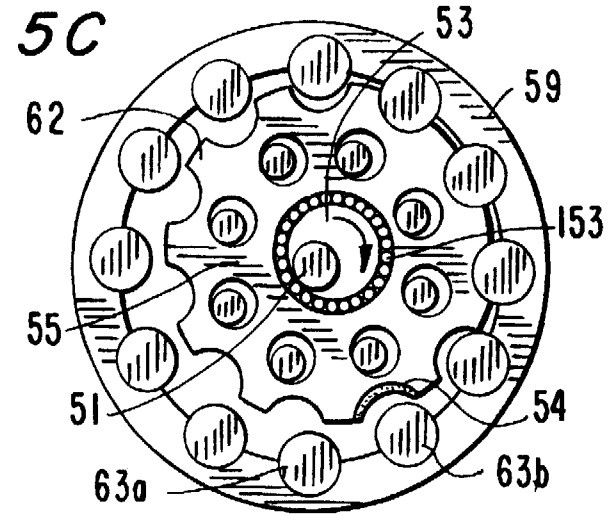

FIG. 5C shows the high speed shaft 51 and the eccentric cam rotated 240° in the clockwise direction with respect to FIG. 5A (i.e., a 2 o'clock position). The cycloidal disc 55 is also displaced 240° within the ring 59. Again, the pins 61 are displaced only slightly.

FIG. 5D shows the high speed shaft 51 and eccentric cam 53 rotated a complete 360° in the clockwise direction with respect to FIG. 5A, returning to the bottom, or 6 o'clock, position. The cycloidal disc 55 is again positioned at the bottom of the ring 59. Since there are only 11 tabs 62 and there are 12 ring rollers 63, the notch 54 (and, similarly, the disc 55) is displaced one roller in the counter-clockwise direction from ring roller 63*a* to ring roller 63*b* as the high speed shaft 51 rotated 360°. Consequently, the pins 61, and thus the low speed shaft 57, are displaced one ring roller 63 counterclockwise. Therefore, every 360° rotation of the high speed shaft 51 in the clockwise direction results in movement of the low speed shaft 57 in the counterclockwise direction corresponding to one ring roller 63.

FIG. 6 is a perspective view, shown in isolation, of the input shaft 40, the low speed shaft 57 and the input arm 12. A first slip disc 113 is mounted on the low speed shaft 57 such that it rotates with the low speed shaft. A second slip disc 115 is mounted on the housing 75 such that it is disposed adjacent to the first slip disc 113 but does not rotate. A signal corresponding to the torque is generated by circuitry 116 mounted on the second slip disc 115. Four coupons 70 are mounted to the low speed shaft in a conventional manner and are spaced equidistant along the circumference of the low speed shaft 57.

Six concentric signal rings 112 are positioned on a first slip disc 113. Two signal rings 112 correspond to the power supply loop. Two other signal rings 112 correspond to the conditioned strain gauge output (i.e., the torque signal). The signals from the coupons are transmitted to the signal rings 112.

Figure 6A:
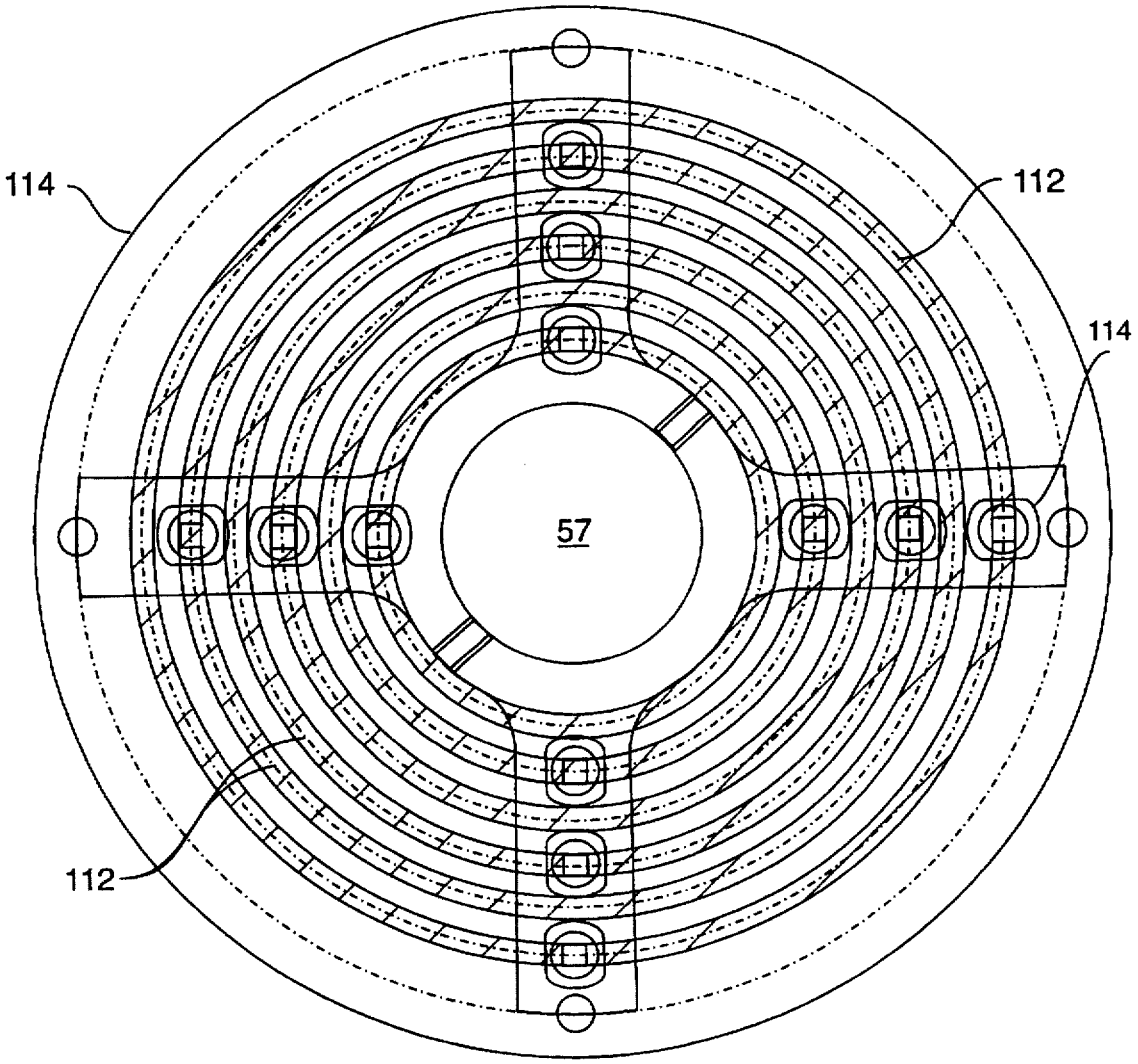
FIG. 6A is a view of a brush slip disc superimposed on the signal rings of a ring slip disc.

Referring to FIGS. 6 and 6A, brushes 114 are mounted to a second slip disc 115. The brushes 114 contact the signal rings 112 on the first slip disc 113 and pick up the coupon signals. Preferably, twelve brushes 114 are used, two brushes allotted for each signal ring 112. The circuitry 116 on the second slip ring 115 converts the coupon signal into a signal corresponding to the torque on the low speed shaft 57. The manner of converting a resistance signal from the coupons 70 to a torque signal is well-known. The torque signal is then transmitted from the circuitry 116 to the dynamometer control board 42 along torque input line 43. This design permits the input shaft 40 to rotate 360° without tangling the input lines 43. Other slip ring assemblies, such as model #AC 4831-6 commercially available from Litton Scientific Inc., would also be acceptable. Circuitry 116 would still be required to convert the coupon signals into torque signals.

To operate the system and method of the present invention, the service provider positions the user on the chair 2, adjusting the position of the chair and the dynamometer 10 such that the joint of the limb to be exercised is aligned with the input shaft 40. (The user may also position him or herself on the chair.) Various known adapter means (e.g., adapter arm 18 of FIG. 2) may be attached to the input arm 12 to engage the limb to the input arm. Additionally, straps may be used to retain the user in place on the chair thereby better isolating the muscles to be exercised.

The service provider selects the exercise, rehabilitation or testing protocol for the user and establishes certain parameters for the protocol, such as the range of motion, the minimum torque which must be created by the user's efforts for the input arm 12 to move (i.e., threshold torque), the isokinetic speed or isotonic torque, and the number of repetitions or time period of exercise, the positional setting of the computer stops, any acceleration or deceleration parameters, as well as any other desired parameters. Referring to FIG. 3, these parameters are entered into the computer 17 by some means, such as the keyboard 16. The computer 17 transmits this information to the dynamometer control board 42 along status line 88. The dynamometer control board 42 is programmed in accord with the control methods described below and uses information from the system to create a control signal. The control signal is sent to the servo amplifier 18 along control line 84 where it is amplified and used to drive the motor in accord with the selected protocol.

Referring to FIGS. 3–5, the motor 30 drives the high speed shaft 51. The eccentric cams 53*a*, 53*b* are thus rotated eccentrically, causing the cycloidal discs 55 to roll around within the ring 59. The displacement of the pinholes 56 as the cycloidal discs 55 are rotated causes the pins 61 to be displaced a much smaller amount in the opposite direction. The displacement of the pins 61 causes the low speed shaft 57 to rotate, thereby also rotating the input shaft 40 and the input arm 12. The user exerts force on the input arm 12, either applying a force in a direction opposite to the direction of movement of the input arm (eccentric motion) or applying a force in the direction of movement of the input arm (concentric motion). The user's force creates a torque on the input shaft 40, which is measured by the torque transducer 41 (FIG. 3). That torque information is used by the dynamometer control board 42 to control the motor 30. The torque value can also be displayed and recorded by the computer 17, stored on a memory unit (disc drive, etc.), or printed.

As noted in the Background section of the present application, existing exercise, physical rehabilitation and extremity testing systems have dynamometers that use complicated and inefficient speed reducers, including systems having worm gears, that require increased maintenance and repair time. These prior art systems are also more costly, larger in size and have many more parts than the system of the present invention. Further, the prior art systems using other types of speed reducers create a high pitched whine and more overall noise while operating, which can be a problem in a clinical or quiet medical setting. In prior art systems, the resistance provided is slack during start up and direction changes as the play between gears is being taken up. Further, bending torque on the shafts creates a loose feel to the user. This backlash problem increases over time as the gears become worn. The system of the present invention creates a "stiff" and "controlled" feel for the user, i.e., the resistance created by the dynamometer 10 is smooth while starting and changing directions of operation creating a more natural movement for the user and the effect of any bending torque is reduced because the cycloidal speed reducer has a higher torsional stiffness. Over time, the system maintains its "controlled feeling since the cycloidal reducer does not wear as fast and, thus, backlash does not increase significantly. Any backlash in the system of the present invention can be reduced further by preloading the pins 61 or the cycloidal discs 55, or other techniques known in the art.

The system of the present invention can use various protocols so that the muscles of the user are subjected to concentric or eccentric motion in isotonic or isokinetic modes, or continuous passive motion. The muscles can also be exercised isometrically. The muscles can even be exercised in different ways within a single exercise protocol. For example, a muscle can be exercised in an isokinetic concentric mode in one direction (i.e., during the primary stroke) and in an isokinetic eccentric mode in the other direction (i.e., during the secondary stroke). Any combination of modes can be selected by the service provider via the computer 17.

MODES OF OPERATION

Isokinetic Concentric/Concentric Mode

Figure 7:
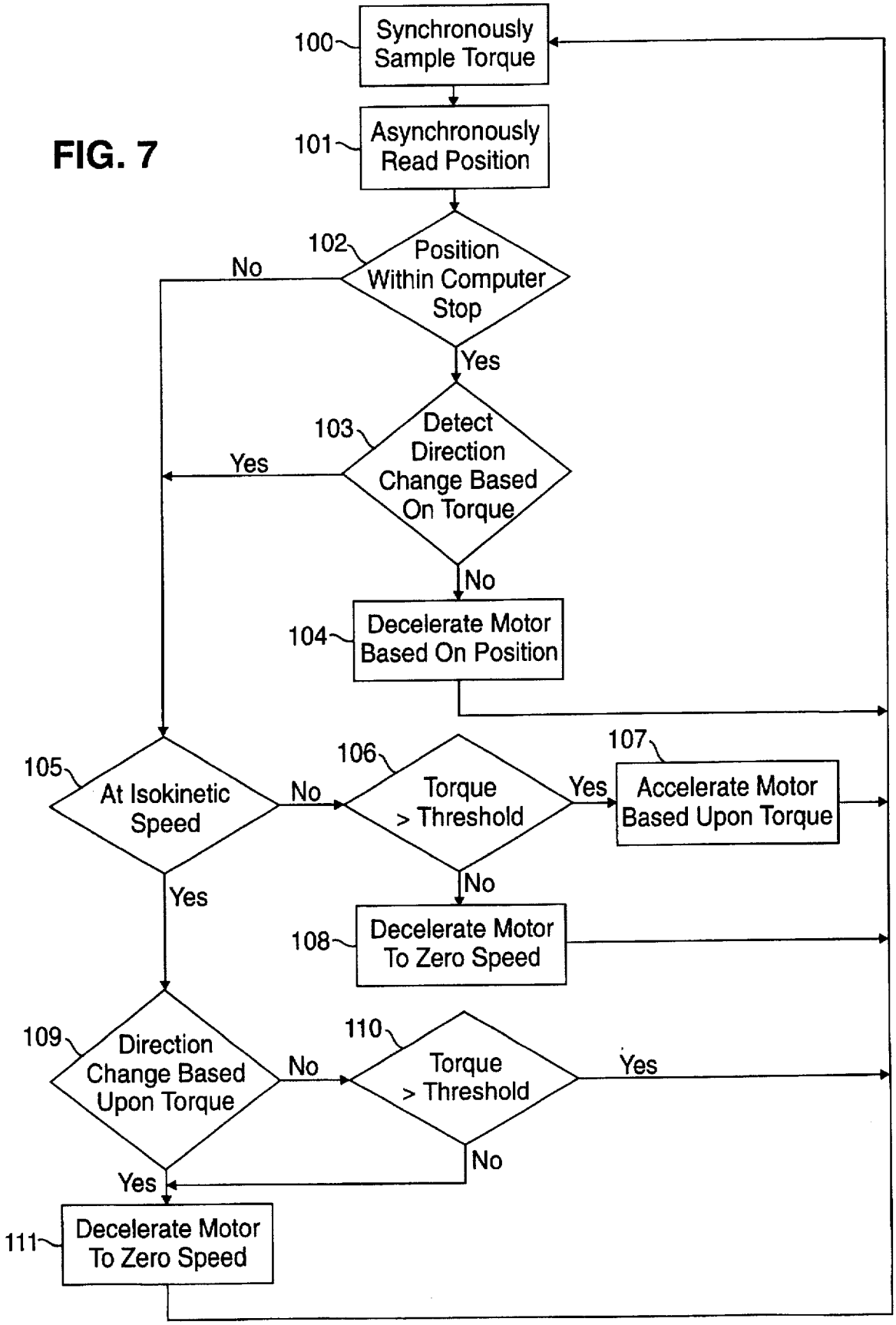
FIG. 7 is a block diagram of the method of controlling the system of FIG. 1 in an isokinetic concentric/concentric mode.

FIG. 7 is a block diagram of an embodiment of the method of control of the exercise system of FIG. 1 operating in an isokinetic concentric/concentric mode, i.e., the limb is exercised concentrically in both strokes at a constant speed. In the concentric/concentric mode (except when operating in the continuous passive motion mode), the user must contract his muscles during both the primary stroke and the secondary stroke. As the limb approaches the end of the range of motion, the dynamometer control board 42 determines that the input arm 12 is within a computer stop and controls the dynamometer 10 to slow the limb down. At the end of the range of motion, the dynamometer 10 will prevent any further movement until the user changes direction. As an additional safety feature, the mechanical stops 26 (FIG. 2) can be used to physically block any movement of the input arm 12 beyond the range of motion. During concentric/concentric operation, the user is free to change the direction of motion in the middle of the stroke.

The torque on the dynamometer input shaft 40, which is measured by the strain gauges, having coupons 70 (FIG. 6) of the torque transducer 41 (FIG. 3), is synchronously sampled by the dynamometer control board 42 (FIG. 3). This step is shown in block 100 in FIG. 7. Reading the torque signal every 2 milliseconds has been found acceptable. The angular position of the high speed shaft 51, which is measured by the optical encoder 72, is asynchronously sampled by the dynamometer control board 42 (block 101 in FIG. 7).

The acceptable range of motion of the low speed shaft 57 is selected by the service provider and entered into the computer 17 via the keyboard 16. This corresponds to an acceptable range of motion of the high speed shaft 51 which, of course, is a larger range. When the patient moves his limb so as to approach the limits of the range, the computer 17 detects the corresponding position of the high speed shaft 51 as within a computer stop (block 102 in FIG. 7). Typically, the computer stop is designated as the last 5°–10° segment of the range of motion. If the high speed shaft 51 is within the computer stop, the dynamometer control board 42 determines whether the user has changed his direction of motion by detecting a polarity change in the torque measurement from the strain gauge 70 (block 103 in FIG. 7). If the user has not changed his direction of motion, the speed of the motor 30 will be reduced depending on the position of the high speed shaft 51 so that the user slows down his limb as he approaches the end of the range of motion. As the high speed shaft 51 nears the end of the range of motion, the motor speed will be reduced further (block 104 in FIG. 7) so that the limb movement is decelerated nearly completely before the change of direction must occur. The dynamometer control board 42 then samples the torque (block 100 in FIG. 7) and control continues.

The service provider selects an isokinetic speed of the input arm 12, thereby selecting the speed for the low speed shaft 57, and enters the isokinetic speed into the computer 17. This corresponds to an isokinetic speed of the high speed shaft 51 which is, of course, much faster. If the high speed shaft 51 is within a computer stop (block 102 in FIG. 7), but the user has already changed the direction of her effort (block 103 in FIG. 7), or if the position of the high speed shaft 51 is determined to be not within the computer stop (block 102), the high speed shaft should be at the isokinetic speed. The speed of the high speed shaft 51 measured by the optical encoder 72 is compared to the isokinetic speed (block 105 in FIG. 7). If the high speed shaft 51 is not rotating at the isokinetic speed, the measured torque is compared to the threshold torque (block 106 in FIG. 7). If the measured torque is greater than the threshold torque, i.e., the user is creating sufficient torque as defined by the service provider (block 106), the motor 30 is accelerated based on the magnitude of the torque in the direction of the measured torque to approach the isokinetic speed (block 107 in FIG. 7). If the actual torque is less than the threshold torque, i.e., the user is not creating sufficient torque as defined by the service provider (block 106), the motor is decelerated to zero speed (block 108 in FIG. 7), preventing further movement until the user increases the torque on the input shaft 40 above the threshold torque. The dynamometer control board 42 then samples the torque (block 100 in FIG. 7) and control continues.

If the high speed shaft 51 is rotating at isokinetic speed (block 105 in FIG. 7), the dynamometer control board 42 determines whether there was a direction change based on the polarity of the torque (block 109 in FIG. 7). If the user has changed the direction of his effort, the motor 30 is decelerated to zero speed (block ill in FIG. 7) so that the motor can be accelerated in the opposite direction. If there was no direction change (block 109), the measured torque is compared to the threshold torque (block 110 in FIG. 7). If the measured torque is greater than the threshold torque, the measured torque is sampled by the dynamometer control board 42 (block 100 in FIG. 7) and control continues as discussed above. If the measured torque is less than the threshold torque (block 110), the motor speed is decelerated to zero speed (block 111). The torque is sampled by the dynamometer control board 42 (block 100) and control continues as discussed above.

Isokinetic Concentric/Eccentric Mode

Figure 8:
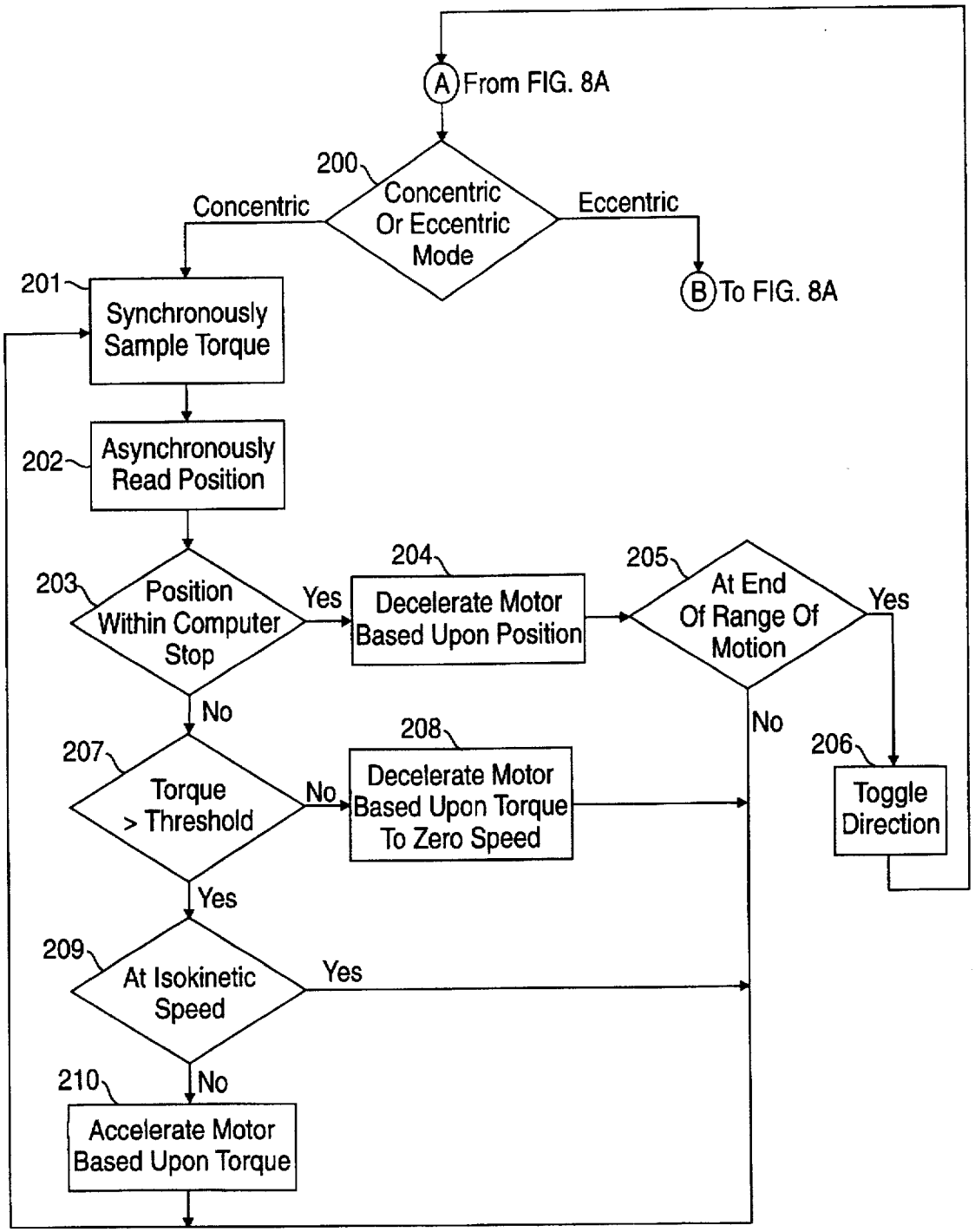
FIGS. 8 and 8A are block diagrams of the method of controlling the system of FIG. 1 in an isokinetic concentric/eccentric mode and an isokinetic eccentric/eccentric mode.
Figure 8A:
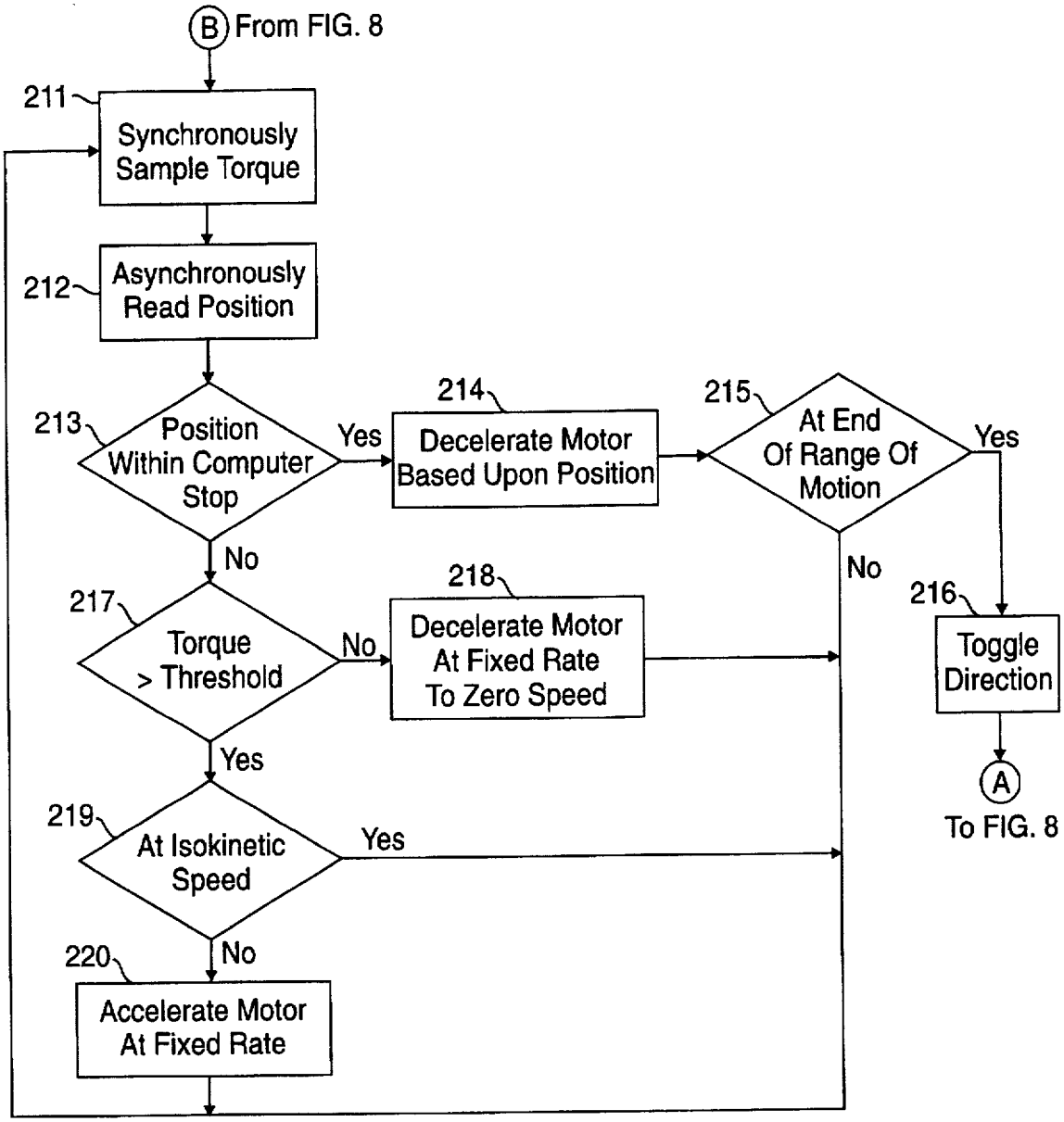

FIGS. 8 and 8A are block diagrams of an embodiment of the method of controlling the system of the present invention operating in an isokinetic concentric/eccentric mode. In this mode, one stroke is performed as the user exerts a force in the direction of movement of the input arm; the other stroke is performed as the user exerts a force in the direction opposite to the direction of movement of the input arm. The input arm rotates at a preset isokinetic speed during each stroke. In the isokinetic concentric/eccentric mode, the user cannot change direction in the middle of a stroke, but only within the computer stops at the end of the range of motion.

Referring to FIGS. 3, 6, 8 and 8A, the dynamometer control board 42 determines whether the system is to perform in the eccentric mode or the concentric mode (block 200 in FIG. 8). If the concentric stroke is being performed, the torque on the input shaft 40 measured by the strain gauges 70 is synchronously sampled by the dynamometer control board 42 (block 201 in FIG. 8). The position of the high speed shaft 51, as measured by the optical encoder 72, is asynchronously sampled (block 202 in FIG. 8). If the high speed shaft 51 is determined by the dynamometer control board 42 to be within the computer stop (block 203 in FIG. 8), the motor 30 is decelerated based on the position of the high speed shaft (block 204 in FIG. 8). If the high speed shaft 51 is at the end of the range of motion (block 205 in FIG. 8), the direction of the motor is changed (block 206 in FIG. 8) and the dynamometer control board 42 determines the next type of stroke to be performed (block 200). If the high speed shaft 51 is not at the end of the range of motion (block 205), the dynamometer control board 42 synchronously samples the torque (block 201) and control continues.

If the high speed shaft 51 is not within the computer stop (block 203 in FIG. 8) (for example, it is in the middle of a stroke), the measured torque is compared to a preset threshold torque (block 207 in FIG. 8). If the measured torque is not greater than the threshold torque (the user is not creating sufficient torque), the motor is decelerated to zero speed (block 208 in FIG. 8), the dynamometer control board 42 synchronously samples the torque (block 201 in FIG. 8), and control continues. The motor speed will remain at zero until the user increases the torque on the input shaft 40.

If the measured torque is greater than the preset threshold torque (block 207 in FIG. 8) (the user is exerting sufficient force), the speed of the high speed shaft 51 is compared with the preset isokinetic speed (block 209 in FIG. 8). If the high speed shaft 51 is rotating at the isokinetic speed, the dynamometer control board 42 samples the torque (block 201 in FIG. 8) and control continues. If the high speed shaft 51 is not rotating at the isokinetic speed, the motor 30 is accelerated in the direction of the measured torque (block 210 in FIG. 8). The dynamometer control board 42 samples the torque (block 201 in FIG. 8) and control continues.

If the dynamometer control board 42 determines that the system is to operate in the eccentric mode (block 200 in FIG. 8), the torque is synchronously sampled (block 211 in FIG. 8A). The position of the high speed shaft 51 is asynchronously read at block 212 in FIG. 8A. If the high speed shaft 51 is determined to be within a computer stop (block 213 in FIG. 8A), the motor is decelerated based on the position of the high speed shaft (block 214 in FIG. 8A). If the high speed shaft 51 is at the end of the range of motion (block 215 in FIG. 8A), the direction of the motor 30 is changed (block 216 in FIG. 8A) and the dynamometer control board 42 determines the next type of stroke to be performed (block 200 in FIG. 8).

If high speed shaft 51 is not within the computer stop (block 213 in FIG. 8A), the torque on the input shaft 40 is compared to the preset threshold torque (block 217 in FIG. 8A). If the measured torque is not greater than the threshold torque (i.e., the user is not creating sufficient torque), the motor 30 is decelerated to zero velocity at a fixed rate (block 218 in FIG. 8A). A gradual deceleration rate is chosen so that it is comfortable for the user, whereas an immediate deceleration could be uncomfortable to the user, or could even cause injury.

If the measured torque is greater than the preset threshold (block 217 in FIG. 8A) (the user is creating sufficient torque), the speed of the high speed shaft 51 is compared to the preset isokinetic speed (block 219 in FIG. 8A). If the high speed shaft 51 is at the preset isokinetic speed, the dynamometer control board 42 samples the torque (block 211 in FIG. 8A) and control continues as discussed above. If the high speed shaft 51 is moving slower than the preset isokinetic speed (block 219), the motor 30 is accelerated at a fixed rate (block 220 in FIG. 8A). Again, the acceleration rate is selected so that it is comfortable for the user. The dynamometer control board 42 samples the torque (block 211) and control continues as discussed above.

Isokinetic Eccentric/Eccentric Mode

The method of control depicted by FIG. 8A is also followed when the system is used in the isokinetic eccentric/eccentric mode. When the high speed shaft 51 reaches the end of the range of motion (block 215 in FIG. 8A), the direction of the motor 30 is changed (block 216 in FIG. 8A). The dynamometer control board 42 then samples the torque (block 211 in FIG. 8A) and control proceeds as discussed above.

Isotonic Concentric/Eccentric Mode

Figure 9:
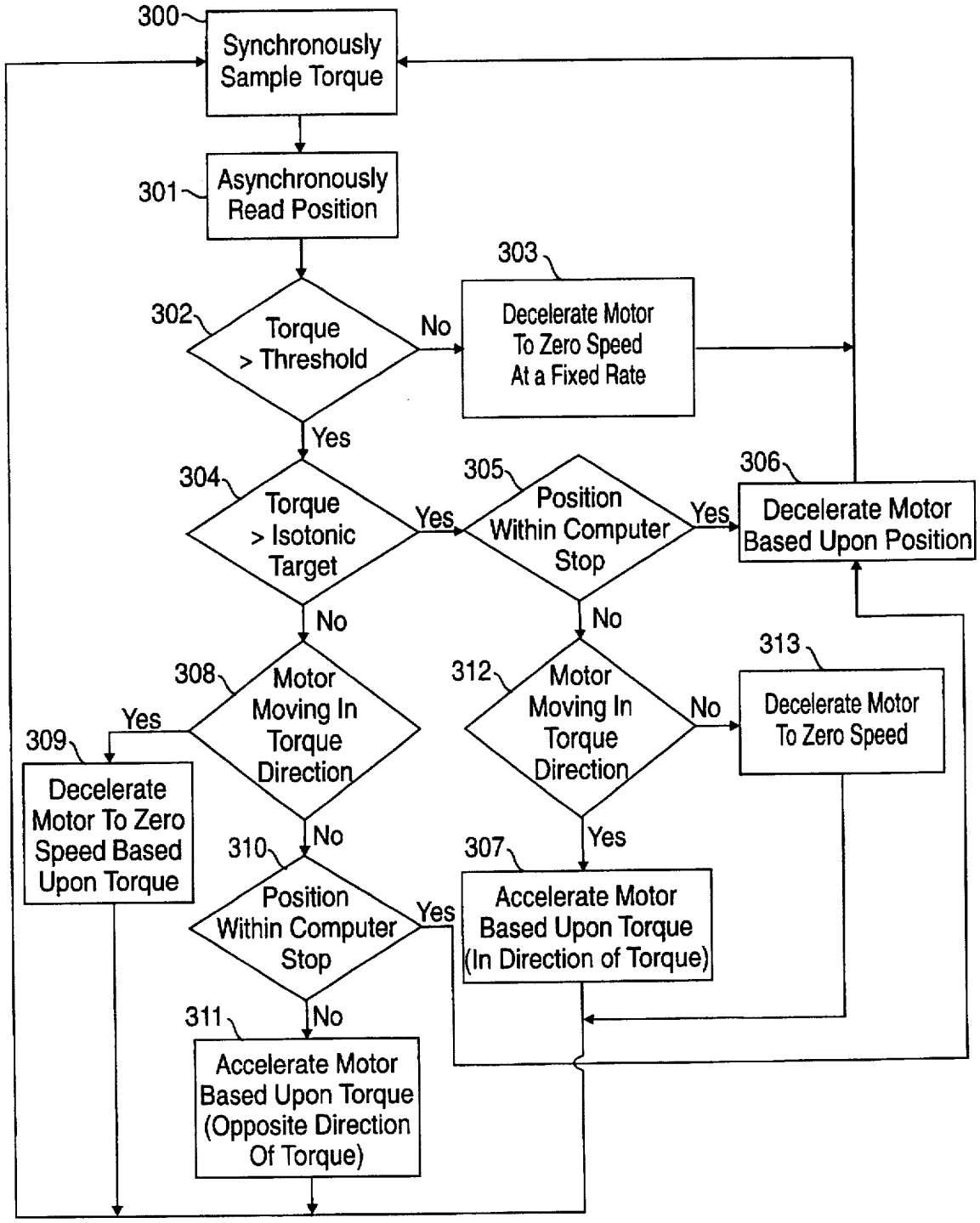
FIG. 9 is a block diagram of the method of controlling the system of FIG. 1 in an isotonic concentric/eccentric mode.

FIG. 9 is a block diagram showing an embodiment of the method of controlling the system of the present invention in an isotonic concentric/eccentric mode. In this mode, the torque on the input shaft 40 is maintained constant throughout the range of motion. Referring to FIGS. 3, 6 and 9, the torque on the input shaft 40 measured by the strain gauges 70 is synchronously sampled by the dynamometer control board 42 (block 300 in FIG. 9). The position of the high speed shaft 51 measured by the optical encoder 72 is asynchronously read by the dynamometer control board 42 (block 301 in FIG. 9). The torque on the input shaft 40 is compared to the threshold torque preset by the service provider (block 302 in FIG. 9). If the torque is not greater than the preset threshold torque (the user is not creating sufficient torque), the motor speed is decelerated at a comfortable rate to zero speed (block 303 in FIG. 9). The dynamometer control board 42 then samples the torque (block 300) and control continues.

If the measured torque is greater than the preset threshold torque (block 302 in FIG. 9), the measured torque is compared to the torque expected if the user was applying a preset isotonic target torque (block 304). If the measured torque is greater than the isotonic target torque, the dynamometer control board 42 determines whether the high speed shaft 51 is within a computer stop (block 305 in FIG. 9). If so, the motor 30 is decelerated based on the position of the high speed shaft 51 (block 306 in FIG. 9). If the high speed shaft 51 is not within a computer stop, it is determined whether the motor 30 is moving in the direction of the torque (block 312 in FIG. 9). If not (i.e., eccentric motion is being performed), the motor 30 is decelerated to zero speed (block 313 in FIG. 9). If the motor is moving in the direction of the torque at block 312 (i.e. concentric motion), the motor 30 is accelerated (block 307), thereby reducing the torque. The dynamometer control board 42 then samples the torque (block 300 in FIG. 9) and control continues.

If the torque is not greater than the isotonic target torque (block 304 in FIG. 9), the dynamometer control board 42 determines whether the motor 30 is moving in the direction that the torque is being exerted (block 308 in FIG. 9) (in other words, is the user engaging in concentric exercise). If so, the motor 30 is decelerated to zero speed based on the torque (block 309 in FIG. 9) because the user is not exerting enough torque to overcome the isotonic target torque.

If the motor is not moving in the direction of the torque (rather the user is engaging in eccentric motion), the system determines whether the high speed shaft 51 is within a computer stop (block 310 in FIG. 9). If not, the motor is accelerated based on the measured torque (block 311 in FIG. 9) thereby increasing the torque. If the high speed shaft 51 is within a computer stop (block 310), the motor 30 is decelerated based on the position of the high speed shaft (block 306 in FIG. 9) in preparation for a direction change. In either case, the dynamometer control board 42 then samples the torque (block 300 in FIG. 9) and control continues.

Isotonic Concentric/Concentric Mode

Figure 10:
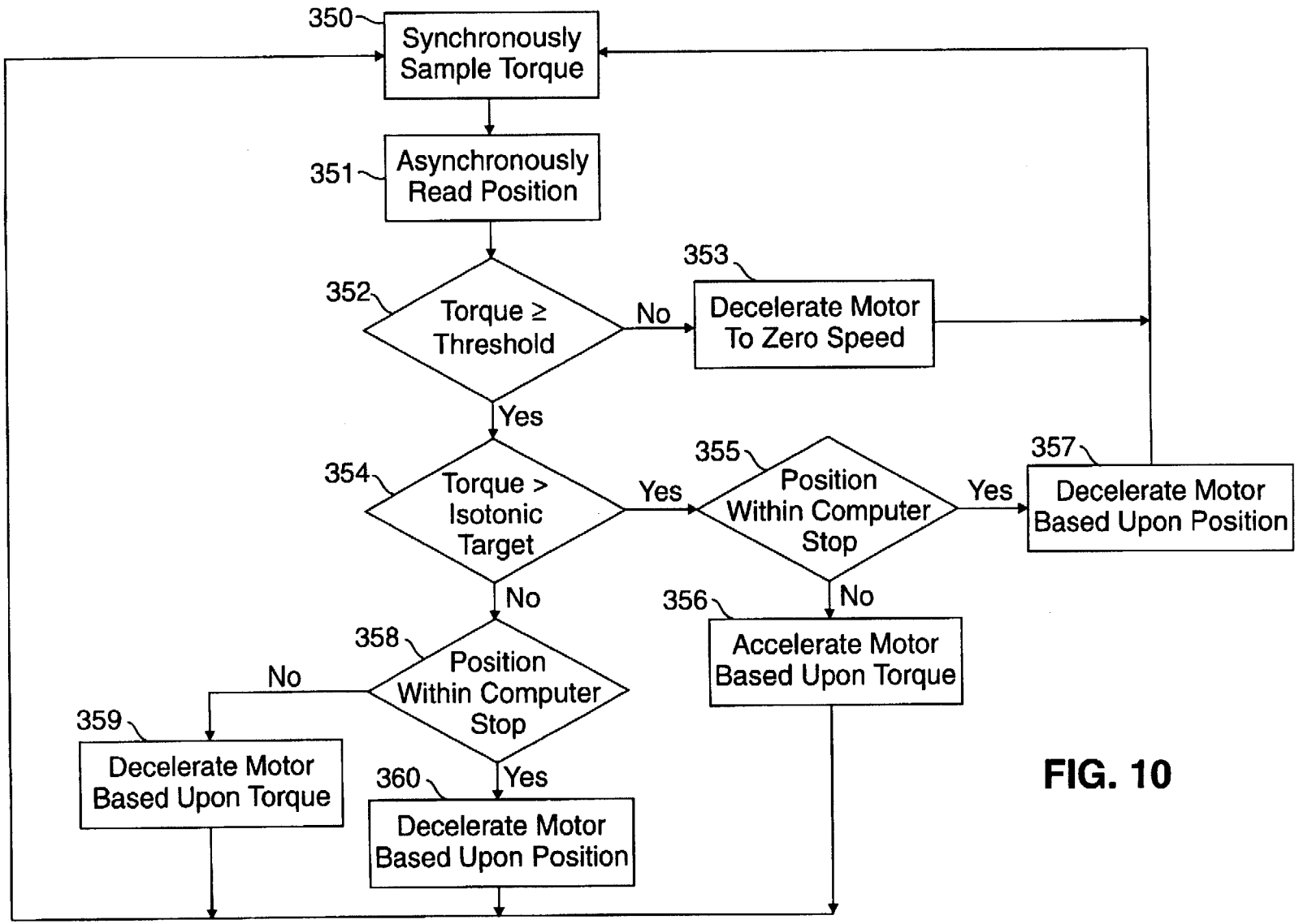
FIG. 10 is a block diagram of the method of controlling the system of FIG. 1 in an isotonic concentric/concentric mode.

FIG. 10 is a block diagram of an embodiment of the method of controlling the system of the present invention operating in a concentric/concentric isotonic mode. Referring to FIGS. 3, 6 and 10, the dynamometer control board 42 synchronously samples the torque on the input shaft 40 measured by the strain gauge 70 (block 350 in FIG. 10). The dynamometer control board 42 then asynchronously reads the position of the high speed shaft 51 as measured by the optical encoder 72 (block 351 in FIG. 10). The dynamometer control board 42 then compares the measured torque to the preset threshold torque (block 352 in FIG. 10). If the measured torque is less than the threshold torque (i.e., the user is not creating sufficient torque), the motor 30 is decelerated to zero speed (block 353 in FIG. 10). The dynamometer control board 42 then samples the torque (block 350) and control continues.

If the measured torque is greater than the threshold torque (block 352 in FIG. 10), the measured torque is compared with the isotonic target torque (block 354 in FIG. 10). If the measured torque is greater than the isotonic target torque, the dynamometer control board 42 determines whether the high speed shaft 51 is within a computer stop (block 355 in FIG. 10). If not, the motor 30 is accelerated in the direction of the torque (block 356 in FIG. 10). If the high speed shaft 51 is within a computer stop (block 355), the motor 30 is decelerated based on the position of the high speed shaft 51 to prepare for the change of direction at the end of the range of motion (block 357 in FIG. 10).

If the measured torque is not greater than the isotonic target torque (block 354 in FIG. 10), the dynamometer control board 42 determines whether the high speed shaft 51 is within a computer stop (block 358 in FIG. 10). If not, the motor 30 is decelerated based on the measured torque (block 359 in FIG. 10). If the high speed shaft 51 is within the computer stop (block 358), the motor 30 is decelerated based on the position of the high speed shaft 51 (block 360 in FIG. 10). The dynamometer control board 42 then samples the torque (block 350 in FIG. 10) and control continues.

Isotonic Eccentric/Eccentric Mode

Figure 11:
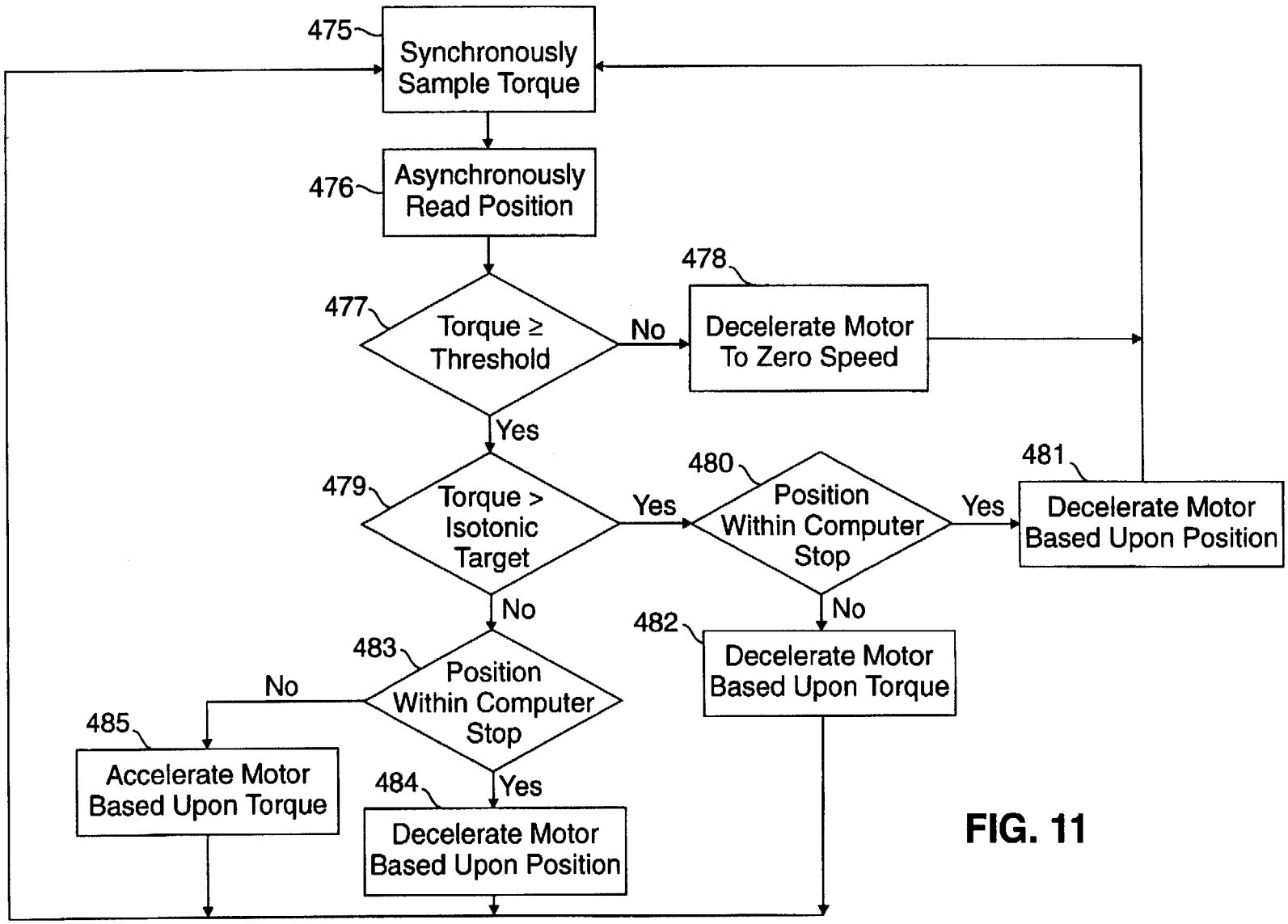
FIG. 11 is a block diagram of the method of controlling the system of FIG. 1 in an isotonic eccentric/eccentric mode.

FIG. 11 is a block diagram of an embodiment of the method of controlling the system of the present invention operating in an eccentric/eccentric isotonic mode. Referring to FIGS. 3, 6 and 11, the dynamometer control board 42 synchronously samples the torque on the input shaft 40 measured by the strain gauges 70 (block 475 in FIG. 11). The dynamometer control board 42 then asynchronously reads the position of the high speed shaft 51 measured by the optical encoder 72 (block 476 in FIG. 11). The measured torque is then compared to the present threshold torque (block 477 in FIG. 11). If the measured torque is less than the threshold torque, the motor 30 is decelerated to zero speed at a comfortable rate (block 478 in FIG. 11). The torque on the input shaft 40 is then sampled by the dynamometer control board 42 (block 475) and control continues.

If the measured torque is greater than or equal to the threshold torque (block 477 in FIG. 11), the measured torque is compared to the isotonic target torque (block 479 in FIG. 11). If the measured torque is greater than the isotonic target torque, the dynamometer control board 42 determines whether the high speed shaft 51 is within a computer stop (block 480 in FIG. 11). If so, the motor 30 is decelerated based on the position of the high speed shaft 51 (block 481 in FIG. 11). If not, the motor 30 is decelerated based on the measured torque (block 482 in FIG. 11). In either case, the dynamometer control board 42 then samples the torque on the input shaft 40 (block 475 in FIG. 11) and control continues.

If the measured torque is not greater than the isotonic target torque (block 479 in FIG. 11), the dynamometer control board 42 determines whether the high speed shaft 51 is within a computer stop (block 483 in FIG. 11). If so, the motor 30 is decelerated based on the position of the high speed shaft 51 (block 484 in FIG. 11). If the high speed shaft 51 is not within a computer stop, the motor 30 is accelerated based upon the torque on the input shaft 40 (block 485 in FIG. 11), thereby increasing the torque. The dynamometer control board 42 then samples the torque on the input shaft 40 (block 475 in FIG. 11) and control continues as discussed above.

Continuous Passive Motion

Figure 12:
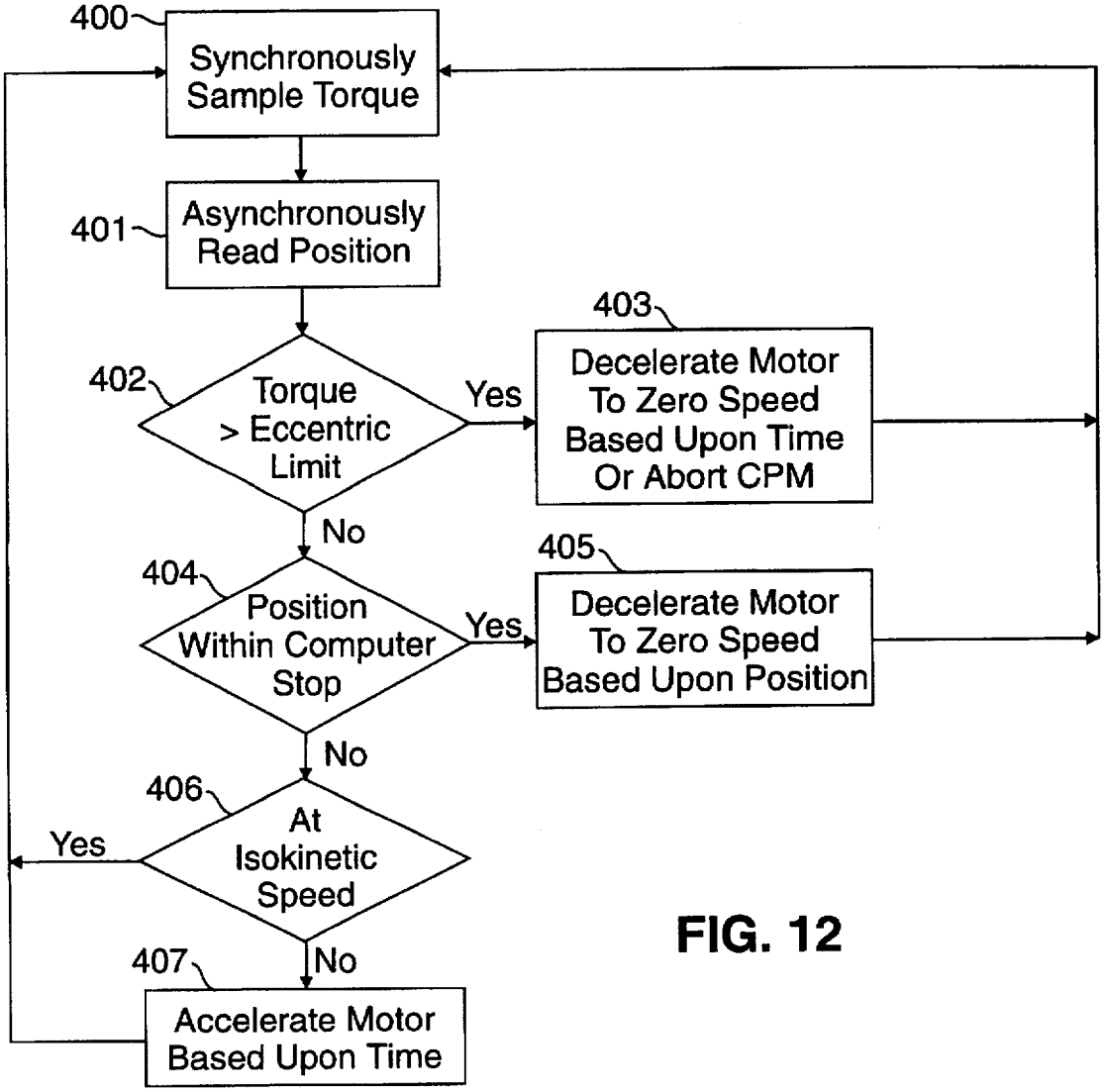
FIG. 12 is a block diagram of the method of controlling the system of FIG. 1 in a controlled passive motion mode.

FIG. 12 is a block diagram of an embodiment of the method of controlling the system of the present invention during continuous passive motion. In this type of exercise, the user does not exert force. Rather, the system moves the user's limb through the range of motion. As a safety feature, an eccentric limit can be entered by the service provider such that, should the user exert a force above the eccentric limit, the system will shut down. This prevents the system from creating too much stress on the limb, thus reducing any risk of injury.

Referring to FIGS. 3, 6 and 12, the torque on the input shaft 40 measured by the strain gauges 70 is synchronously sampled by the dynamometer control board 42 (block 400 in FIG. 12). The position of the high speed shaft 51 measured by the optical encoder 72 is asynchronously sampled by the dynamometer control board 42 (block 401 in FIG. 12). The torque on the input shaft 40 is compared to the eccentric limit set by the service provider (block 402 in FIG. 12). If the measured torque is greater than the eccentric limit, the motor 30 is decelerated at a comfortable rate, or stopped immediately (block 403 in FIG. 12). The dynamometer control board 42 then samples the torque (block 400) and control continues.

If the measured torque is not greater than the eccentric limit (block 402 in FIG. 12), the dynamometer control board 42 determines whether the high speed shaft is within a computer stop (block 404 in FIG. 12). If so, the motor 30 is decelerated based on the position of the high speed shaft 51 (block 405 in FIG. 12). The motor changes direction following the deceleration at the end of the range of motion. The dynamometer control board 42 then samples the torque (block 400 in FIG. 12) and control continues.

If the high speed shaft 51 is not within a computer stop (block 404 in FIG. 12), the speed of the high speed shaft is compared to the preset isokinetic speed (block 406 in FIG. 12). If the high speed shaft 51 is moving at the preset isokinetic speed, the dynamometer control board 42 then samples the torque (block 400 in FIG. 12) and control continues. If the high speed shaft 51 is below the preset isokinetic speed, the motor 30 is accelerated at a comfortable rate (block 407 in FIG. 12). Then, the dynamometer control board 42 samples the torque (block 400 in FIG. 12) and control continues.

Isometric Mode

Figure 13:
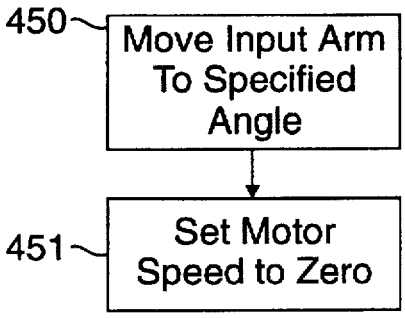
FIG. 13 is a block diagram of the method of controlling the system of FIG. 1 in an isometric mode.

FIG. 13 is a block diagram of the method of controlling the system of the present invention operating in an isometric mode. In isometric exercise, the user tries to move his limb against an immovable object. Consequently, the muscle is exercised at specified fixed points in the range of motion which point is entered into the computer 17 by the service provider.

Referring to FIGS. 3 and 13, the motor 30 is driven so that the input arm 12 is moved to the angle specified by the service provider (block 450). The motor speed is then set to zero (block 451).

My invention is defined by the following claims:

I claim:

1. An apparatus for exercise, physical rehabilitation or extremity testing of a limb or body segment of a user comprising:

a base;

a track mounted to the base, the track having two ends and a longitudinal central axis;

a chair mounted to the track at a selected point between the two ends;

a stand fixedly mounted to the base proximate one end of the track in line with said track central axis.;

a post mounted to the stand;

a brace rotatably mounted to the post; and a dynamometer rotatably mounted to the brace wherein the dynamometer comprises:

a motor having an output shaft;

a cycloidal speed reducer having a high speed shaft and a low speed shaft wherein the high speed shaft is mounted to the output shaft and wherein the high speed shaft and the low speed shaft are operably connected such that the high speed shaft rotates faster than the low speed shaft; and a dynamometer input shaft mounted to the low speed shaft, the input shaft being capable of engaging the limb or body segment of the user of the apparatus.

2. The apparatus of claim 1 wherein the cycloidal speed reducer includes two cycloidal discs disposed about the high speed shaft.

3. A system for exercising, rehabilitation or extremity testing of a user in a concentric, eccentric or isometric mode comprising:

a base;

a track having a first end and a second end, the track being mounted to the base;

a chair rotatably mounted to the track at a selected position between the first end and the second end;

a stand mounted to the base proximate the first end of the track in fixed lateral relation to said track;

a brace rotatably mounted to the stand;

a means for adjusting the height of the brace mounted to the stand;

a dynamometer rotatably mounted to the brace, the dynamometer having:

a low speed shaft;

an input shaft mounted to the low speed shaft; and a means for engaging a user's body part to input the shaft.

4. The system of claim 3 further comprising means for controlling the output of the dynamometer, means for measuring the torque on the input shaft and means for transmitting a signal corresponding to the torque to the controlling means.

5. The system of claim 4 wherein the controlling means comprises a computer processor.

6. The system of claim 5 wherein the computer processor includes a dynamometer control board.

7. The system of claim 6 further comprising a programmable computer operably engaged to the dynamometer control board wherein a service provider can enter a mode of operation on the computer.

8. The system of claim 3 further comprising means for determining torque on said input shaft.

9. The system of claim 8 wherein said torque determining means comprises a torque transducer mounted to said low speed shaft.

10. The system of claim 3 wherein said dynamometer further comprises:

a high speed shaft operably connected to said low speed shaft such that the high speed shaft rotates faster than said low speed shaft;

a motor operably connected to said high speed shaft; and means for controlling the speed of said motor.

11. The system of claim 10 further comprising means for determining the speed of the high speed shaft.

12. The apparatus of claim 11 further comprising means for determining the position of the high speed shaft.

13. The system of claim 12 wherein said speed determining means and said position determining means comprise an optical encoder mounted adjacent said high speed shaft.

14. The system of claim 10 wherein said control means includes means for controlling the speed of said motor based, at least in part, on the torque on said input shaft, the speed of said high speed shaft and the position of said input shaft.

15. A method of constructing an apparatus for exercising, rehabilitation or extremity testing comprising the steps of:

constructing a dynamometer by mounting a motor to a high speed shaft of a reducer and mounting an input shaft to a low speed shaft of the reducer;

pivotally mounting the dynamometer to a post having means for locking the dynamometer in a fixed position;

slidingly mounting the post to a stand;

fixedly mounting the stand to a base;

operably engaging the motor to a means for controlling the speed of the motor;

mounting a chair to a chair stand; and mounting the chair stand at a selected location on a track in the base, said track having a longitudinal central axis, wherein said stand is mounted to said base in line with said track central axis.

16. The method of claim 15 wherein constructing a dynamometer further comprises mounting at least one strain gauge to the input shaft.

17. The method of claim 15 wherein the step of mounting the chair to the chair stand further comprises rotatably mounting the chair to the chair stand.

18. An apparatus for exercising, rehabilitation or extremity testing comprising:

a platform;

a track mounted to the platform;

a stand mounted to the track at a selected position along the track;

a chair mounted to the stand;

a post having an adjustable height mounted to the platform distal to the track in fixed lateral relation to said platform;

a dynamometer rotatably mounted to the post, the dynamometer comprising:

a cycloidal speed reducer having a high speed shaft and a low speed shaft wherein the high speed shaft rotates faster than the low speed shaft;

an input shaft directly engaged to the low speed shaft;

a motor directly engaged to the high speed shaft such that the motor drives the high speed shaft and, thus, the low speed shaft; and means for controlling the motor operably engaged to the motor.

19. The apparatus of claim 18 further comprising means for measuring torque on the input shaft and means for measuring the speed of the high speed shaft.

20. The apparatus of claim 19 further comprising means for displaying the torque and speed.

21. The apparatus of claim 19 wherein said torque measuring means comprises a torque transducer mounted to said low speed shaft and wherein said speed measuring means comprises an optical encoder mounted proximate said high speed shaft.

22. The apparatus of claim 19 further comprising means for determining the position of said input shaft.

23. The apparatus of claim 22 wherein said position determining means comprises an optical encoder mounted proximate said high speed shaft.

24. The apparatus of claim 22 wherein said control means includes means for controlling the speed of said motor based, at least in part, on the speed of said high speed shaft, the torque on said input shaft and the position of said input shaft.

25. A method of exercise, physical rehabilitation or extremity testing comprising:

positioning a user on a chair;

adjusting the position of the chair along a track, said track being mounted to a base;

engaging the limb or body segment to an input arm, which input arm is mounted to an input shaft of a dynamometer, said dynamometer being mounted in fixed lateral relation to said base;

controlling a motor, which motor is directly engaged to a high speed shaft of the dynamometer; and driving the input shaft with the high speed shaft via a cycloidal speed reducer.

26. The method of claim 25 further comprising adjusting the height and angular orientation of the dynamometer.

27. The method of claim 25 further comprising measuring torque on the input shaft.

28. The method of claim 27 further comprising measuring the position and speed of the high speed shaft.

29. The method of claim 28 wherein the step of controlling the motor comprises selecting a protocol.

30. The method of claim 29 wherein the motor speed is controlled, at least in part, based on the selected protocol, torque, position and speed.

* * * * *